US012709874B2

(12) United States Patent
Wells et al.

(10) Patent No.: US 12,709,874 B2
(45) Date of Patent: Aug. 18, 2026

(54) RETENTION SYSTEM WITH THREADED BLOCK LOCKING MECHANISM

(71) Applicant: CATERPILLAR INC., Peoria, IL (US)

(72) Inventors: Corey Michael Wells, East Peoria, IL (US); Eric Thomas Sinn, Tremont, IL (US); Brandon Hammig McCaffrey, St. Louis, MO (US); William Jay Ulrich, IV, East Peoria, IL (US); Douglas Charles Serrurier, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 466 days.

(21) Appl. No.: 18/356,290

(22) Filed: Jul. 21, 2023

(65) Prior Publication Data

US 2025/0027299 A1 Jan. 23, 2025

(51) Int. Cl.
*E02F 9/28* (2006.01)

(52) U.S. Cl.
CPC ..... *E02F 9/2841* (2013.01); *E02F 9/2825* (2013.01)

(58) Field of Classification Search
CPC ..... E02F 9/2808; E02F 9/2816; E02F 9/2833; E02F 9/2858; E02F 9/2841; E02F 9/2825; E02F 9/285; E02F 9/2883
See application file for complete search history.

(56) References Cited

U.S. PATENT DOCUMENTS

| | | | | |
|---|---|---|---|---|
| 8,434,248 | B2 * | 5/2013 | Woerman | E02F 9/2825 37/456 |
| 9,512,599 | B2 | 12/2016 | Rol Corredor et al. | |
| 10,364,553 | B2 | 7/2019 | Snyder | |
| 2010/0162594 | A1 | 7/2010 | Bierwith | |
| 2022/0333358 | A1 * | 10/2022 | Wood | E02F 9/285 |

FOREIGN PATENT DOCUMENTS

| | | | |
|---|---|---|---|
| AU | 2020265894 | B2 | 11/2020 |
| KR | 101806958 | B1 | 12/2017 |
| WO | 2022256874 | | 12/2022 |

* cited by examiner

*Primary Examiner* — Joseph M Rocca
*Assistant Examiner* — Robert E Pezzuto

(57) ABSTRACT

A retention mechanism for connecting a ground engaging tip and an adapter has a spring, a retainer block configured for insertion into a cutout in the adapter, and a retainer. The retainer block has a cavity having an internal thread. The retainer block also has an outer surface defining a contact surface, a back surface opposite the contact surface, and a plurality of angled surfaces between the contact surface and the back surface. Further, the retainer block has a slot passing through the back surface and configured to receive the spring. The retainer is configured for insertion in in the cavity of the retainer block. The retainer has a threaded outer surface configured to engage with the internal thread of the retainer block, a detent cutout configured to receive a portion of the spring, and a chamfered bottom surface configured to engage with and deflect the portion of the spring.

20 Claims, 41 Drawing Sheets

RETENTION SYSTEM WITH THREADED BLOCK LOCKING MECHANISM

TECHNICAL FIELD

The present disclosure relates generally to earth working machines with ground engaging implements, and, more particularly, to ground engaging implements having retention mechanisms with threaded block locking mechanisms.

BACKGROUND

Earth-working machines such as, for example, excavators, wheel loaders, hydraulic mining shovels, cable shovels, bucket wheels, bulldozers, and draglines are generally used for digging or ripping into the earth or rock and/or moving loosened work material from one place to another on a worksite. These earth-working machines include various earth-working implements, such as a bucket or a blade, for excavating or moving the work materials. These implements can be subjected to extreme wear from the abrasion and impacts experienced during earth-working applications.

To facilitate the earth-moving process and to prolong the useful life of the implement, a plurality of tip assemblies may be placed along a base edge of the implement and attached to the surface of the implement. The tip assemblies project forward from the base edge as a first point of contact and penetration with work material and reduce the amount of wear on the base edge. With this arrangement, the tip assemblies may be subjected to the wear and breakage caused by repetitive engagement with the work material. Eventually, the tip assemblies must be replaced, but the implement may remain useable through multiple cycles of replacement tip assemblies. Depending on the variety of uses and work materials for the equipment, it may also be desirable to change the type and/or shape of the tip assemblies to most effectively utilize the implement.

Installation and replacement of the tip assemblies may be facilitated by providing the tip assemblies in a two-part system. The system may include an adapter that is attached to the base edge of the implement and a ground engaging tip configured to be attached to the adapter. The adapter and the ground engaging tip may be connected by a retention mechanism. The adapter may be welded, bolted, or otherwise secured to the base edge and the tip may be attached to the adapter and held in place by the retention mechanism.

U.S. Pat. No. 10,364,553 ("the '553 patent") of Christopher D. Snyder issued on Jul. 30, 2019 and discloses a ground engaging tool tip assembly including a base, a wear member, and a lock. The lock includes a retainer and a lock body. The lock body passes through aligned openings in the base, the retainer, and the wear member to engage the retainer and secure the wear member to the base. The lock body and retainer include corresponding fasteners with engaging elements such as lugs and threads.

The '553 patent may provide a ground engaging tool assembly including a base, a wear member, and a lock. The '553 patent, however, requires a lock body that is held in place in the wear member by a nut or retention ring. Providing a lock body and nut or retention ring may require precise manufacturing tolerances that may potentially reduce the sufficiency of the locking mechanism. Additionally, it may be difficult to ensure that the lock body has been tightened to a proper amount to provide maximum support to the ground engaging tool tip assembly of the '553 patent.

This disclosure is directed to overcoming one or more of the problems set forth above and other problems in the prior art.

SUMMARY

In one aspect, the present disclosure is directed to a retention mechanism for connecting a ground engaging tip and an adapter. The retention mechanism includes a spring. The retention mechanism also includes a retainer block configured for insertion into a cutout in the adapter. The retainer block includes a cavity having an internal thread. The retainer block also includes an outer surface defining a contact surface, a back surface opposite the contact surface, and a plurality of angled surfaces between the contact surface and the back surface. Further, the retainer block includes a slot that passes through the back surface and is configured to receive the spring. The retention mechanism includes a retainer configured for insertion in the cavity of the retainer block. The retainer includes a threaded outer surface configured to engage with the internal thread of the retainer block, a detent cutout configured to receive a portion of the spring, and a chamfered bottom surface configured to engage with and deflect the portion of the spring.

In another aspect, the present disclosure is directed to an adapter nose for connecting a ground engaging tip to a base edge of a ground engaging implement. The adapter nose includes a front surface, a top surface, a bottom surface, wherein the top surface and the bottom surface extend forward from a rear edge of the adapter nose and converge at the front surface of the adapter nose, first and second side surfaces extending forward from the rear edge of the adapter nose to the front surface, and a cutout in the first side surface configured to accept a retainer block, wherein the cutout comprises a plurality of inner side surfaces connected to a base surface by a plurality of inner rounded surfaces.

In yet another aspect, the present disclosure is directed to a tip assembly. The tip assembly includes an adapter. The adapter includes an adapter nose comprising a front surface, a top surface, a bottom surface, wherein the top surface and the bottom surface extend forward from a rear edge of the adapter nose and converge at the front surface of the adapter nose, first and second side surfaces extending forward from the rear edge of the adapter nose to the front surface, and a cutout in the first side surface, wherein the cutout comprises a plurality of inner side surfaces connected to an inner surface by a plurality of inner rounded surfaces. A ground engaging tip includes a nose cavity configured to receive the adapter nose. The ground engaging tip includes a rear edge, a top outer surface, a bottom outer surface, wherein the top outer surface and the bottom outer surface extend forward from the rear edge and converge at a front edge of the ground engaging tip, first and second lateral outer surfaces extending forward from the rear edge to the front edge, wherein the first lateral outer surface includes an opening for installation of a retainer. A retention mechanism includes a spring, a retainer block configured for insertion into the cutout in the first side surface of the adapter, and a retainer configured for insertion in a cavity of the retainer block through the opening in the first lateral outer surface of the ground engaging tip, the retainer being further configured to receive at least a portion of the spring in a detent cutout of the retainer.

DETAILED DESCRIPTION

Figure 1:
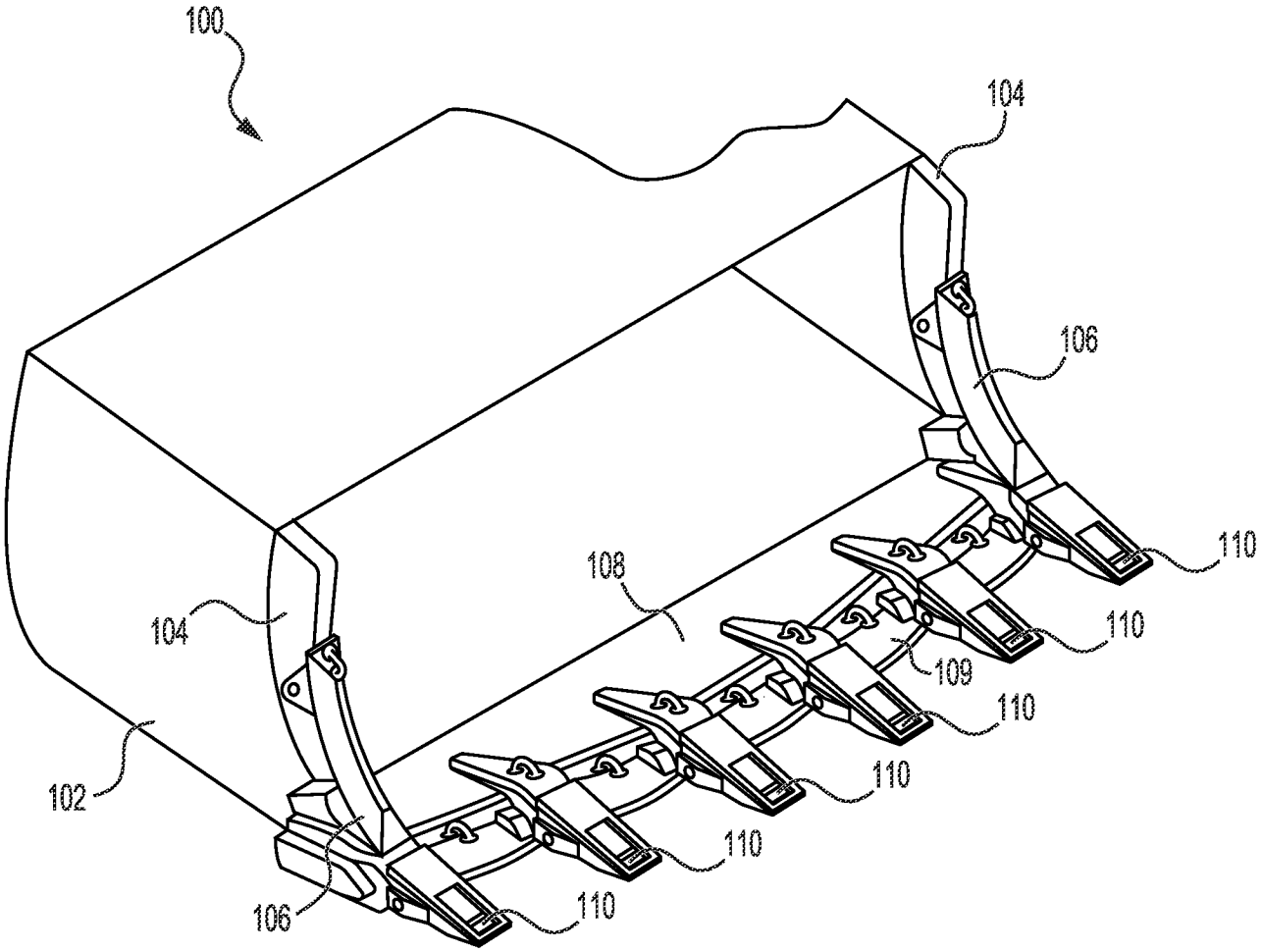
FIG. 1 is an isometric view of an exemplary loader bucket having tip assemblies.

FIG. 1 illustrates an exemplary implement 100 for a bottom-wearing application, such as a loader machine application. The implement 100 may take the form of a bucket assembly that incorporates the features of the present disclosure. The bucket assembly may include bucket 102 which is partially shown in FIG. 1. Bucket 102 may be used on the loader machine to excavate material. The bucket assembly may include a pair of oppositely-disposed arms 104 on which corresponding corner guards 106 may be mounted. Bucket 102 may include a plurality of tip assemblies 110. The bucket assembly may further include a number of edge protector assemblies 109 interposed between tip assemblies 110, with the edge protector assemblies 109 and the tip assemblies 110 being secured along a base edge 108 of the bucket 102.

Figure 2:
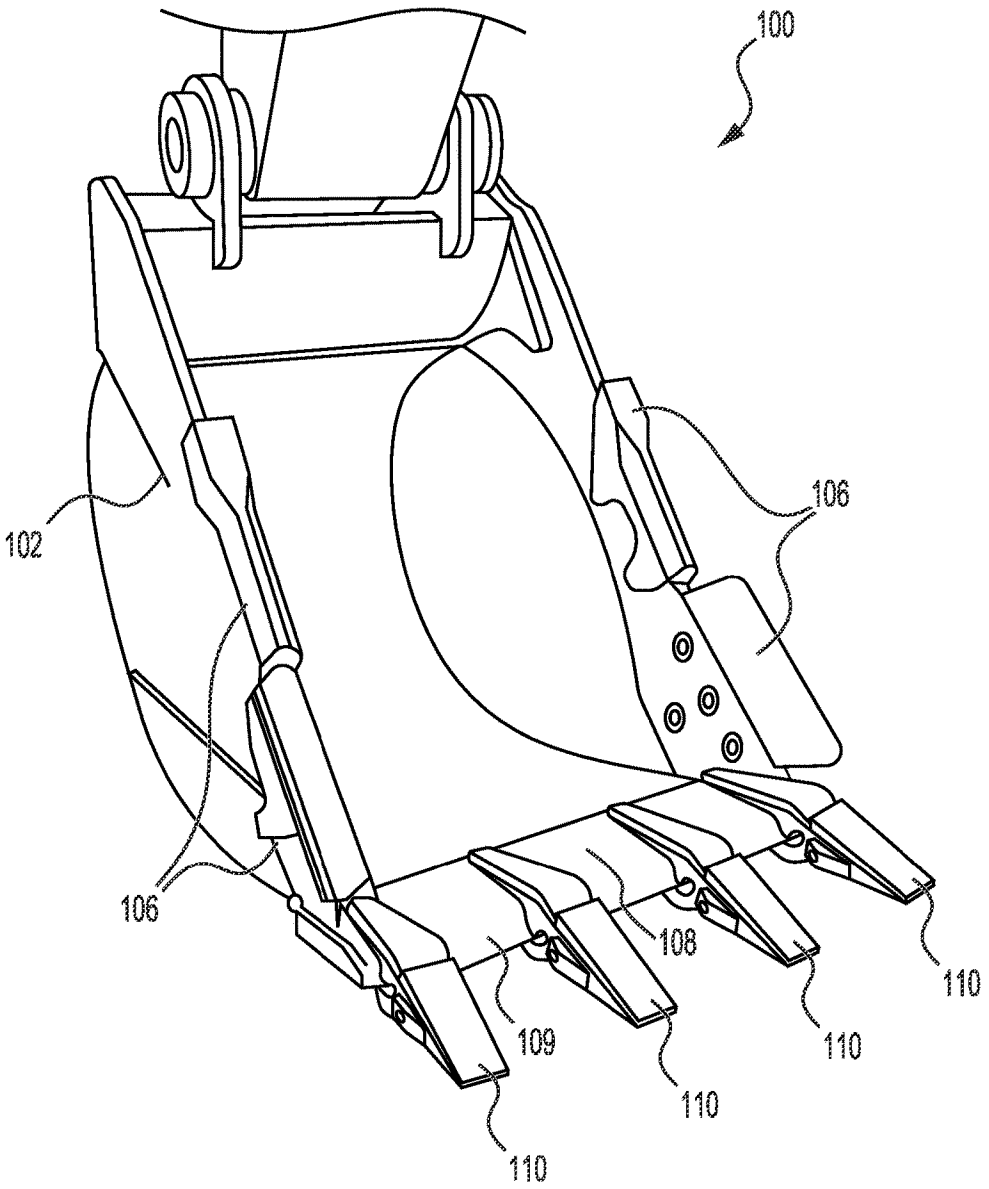
FIG. 2 is an isometric view of an exemplary excavator bucket having tip assemblies.

FIG. 2 illustrates another exemplary implement 100 for a top wearing application, such as an excavator application. In this example, the implement 100 may have the form of an excavator bucket assembly. The excavator bucket assembly may include a bucket 102 having corner guards 106 on either side. Bucket 102 may include a plurality of tip assemblies 110. The excavator bucket assembly may further include edge protector assemblies 109 interposed between tip assemblies 110, with the edge protector assemblies 109 and the tip assemblies 110 being secured along a base edge 108 of the bucket 102.

Various embodiments of tip assemblies may be implemented in bottom-wearing or top-wearing applications. Although a particular tip assembly or component embodiment may be described with respect to a particular bottom-wearing or top-wearing application, it is to be understood that the tip assemblies are not limited to a particular type of application and may be interchangeable between implements of various applications.

Figure 3:
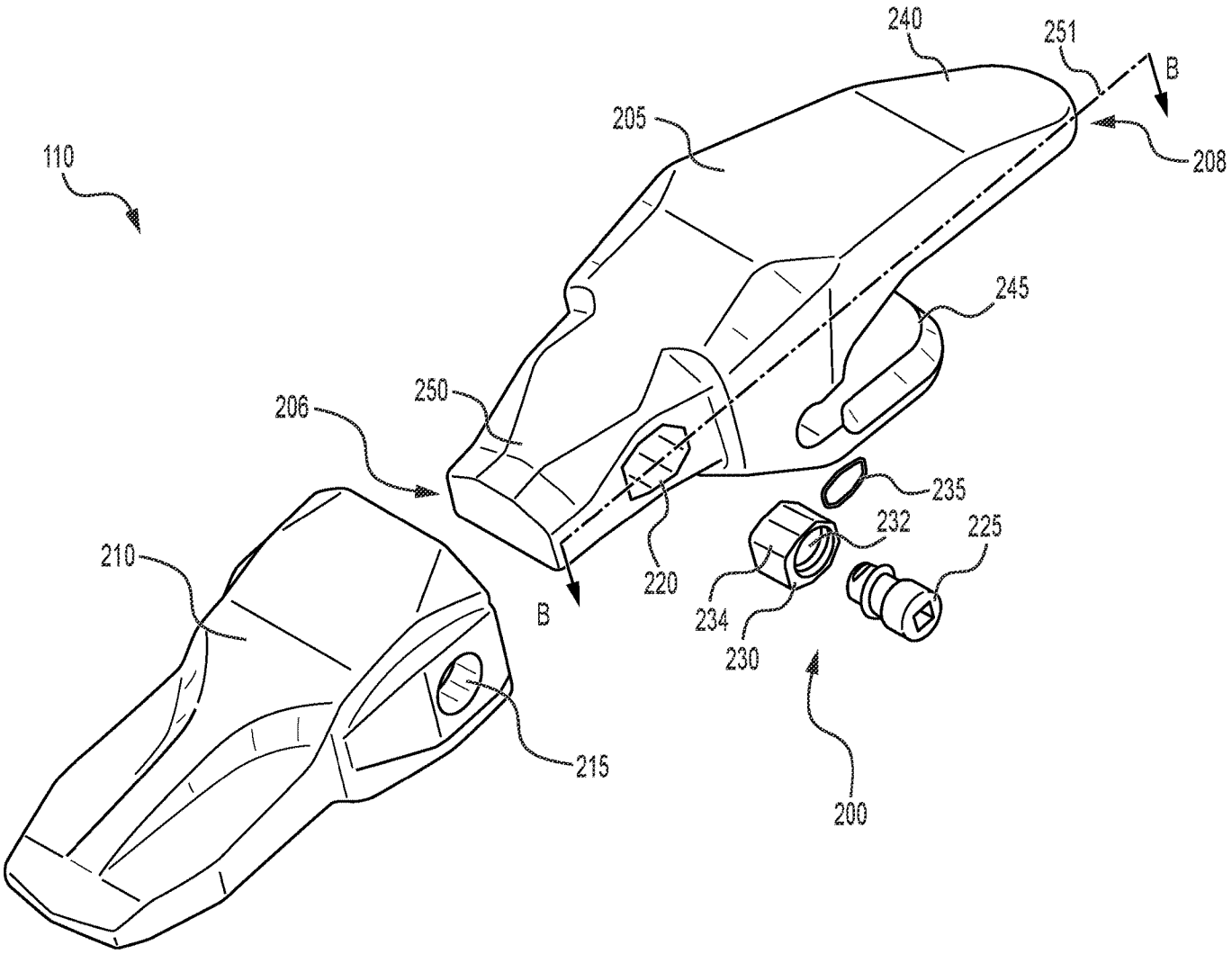
FIG. 3 is an exploded view of an exemplary tip assembly.

FIG. 3 is an exploded view illustrating components of an exemplary tip assembly 110. Tip assembly 110 may be used on multiple types of ground engaging implements that have a base edge, such as base edge 108 (see FIGS. 1-2). Tip assembly 110 may include an adapter 205 configured for attachment to a base edge, such as the base edge 108 of the implement 100, and a ground engaging tip 210 configured for attachment to the adapter 205. The tip assembly 110 may further include a retention mechanism 200 for securing the ground engaging tip 210 to the adapter 205. The retention mechanism 200 may comprise a retainer 225, a retainer block 230, and a spring 235. Adapter 205 may include a cutout 220 to allow for installation of retainer block 230. Ground engaging tip 210 may include an opening 215, such as a thru hole, to allow for installation of retainer 225 into retainer block 230 when ground engaging tip 210 is connected to adapter 205. Once attached to the adapter 205, the ground engaging tip 210 may extend outwardly from a base edge, such as the base edge 108 of the implement 100, for initial engagement with work material.

Adapter 205 may extend from front end 206 to rear end 208 and may include a top strap 240 and a bottom strap 245. In one exemplary embodiment as illustrated in FIG. 3, the top strap 240 may be positioned higher than bottom strap 245 relative to a direction of gravity. However, the terms top and bottom should be understood as defining positions relative to each other and are not required to be relative to a direction of gravity. For example, depending on a position of implement 100 on a machine or when detached from a machine, the top strap 240 may be positioned higher or lower than the bottom strap 245 relative to a direction of gravity.

The top strap 240 and bottom strap 245 may define a gap therebetween for receiving the base edge 108 of the implement 100 (see FIGS. 1-2). The top strap 240 may have a bottom surface that may oppose and engage a top surface of the base edge 108. The bottom strap 245 may have a top surface that may oppose and engage a bottom surface of the base edge 108. Adapter 205 may be secured in place on the base edge 108 by attaching top strap 240 and bottom strap 245 to the base edge 108 using any known connection method or mechanism. In one embodiment, top strap 240, bottom strap 245, and base edge 108 may have corresponding apertures through which fasteners such as bolts or rivets may be inserted to hold adapter 205 in place. Alternatively, top strap 240 and bottom strap 245 may be welded to the corresponding top and bottom surfaces of the base edge 108 so that adapter 205 and the base edge 108 do not move relative to each other during use. Adapter 205 may also include a nose 250 that may have a longitudinal axis 251 passing through a center of the nose 250 in a direction from front end 206 to rear end 208 of adapter 205.

Figure 5:
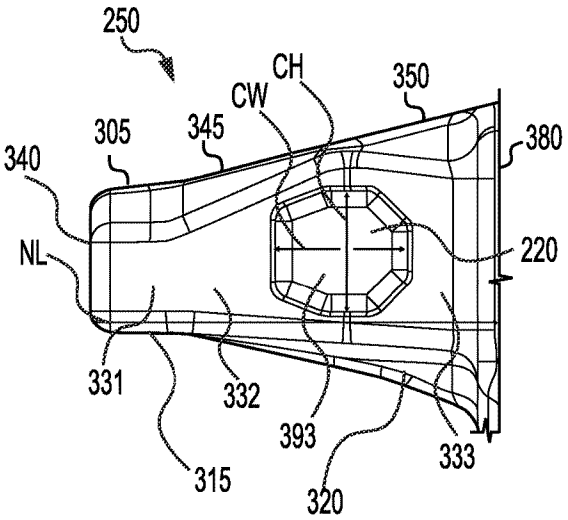
FIG. 5 is a side view of the nose of the adapter of FIG. 4.
Figure 4:
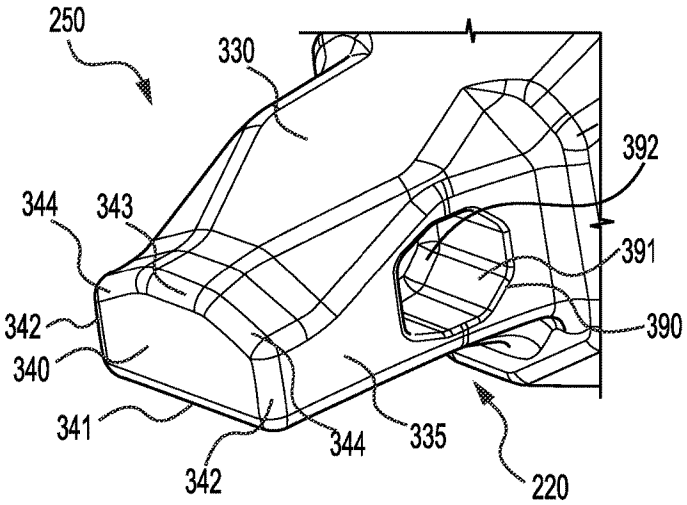
FIG. 4 is an isometric view of a nose of an exemplary adapter of the tip assembly of FIG. 3.
Figure 6:
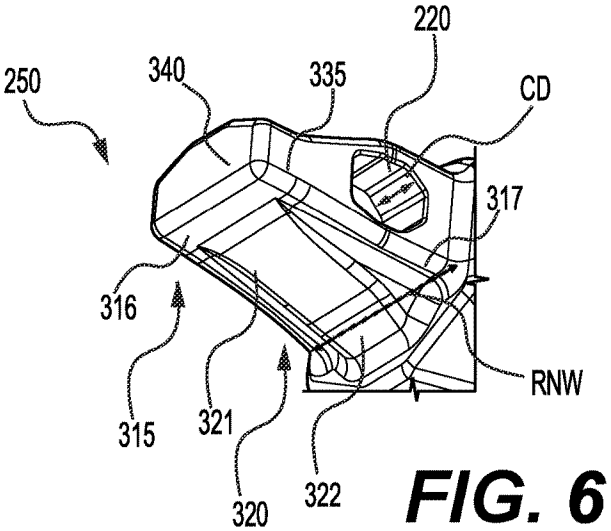
FIG. 6 is a lower isometric view of the nose of the adapter of FIG. 4.

FIGS. 4-6 depict various views of the nose 250 of adapter 205 (see FIG. 3) As depicted in FIGS. 4-6, nose 250 of adapter 205 may have a bottom surface 315, a top surface 330, opposing side surfaces 335, a front surface 340, and a rear edge 380. The rear edge 380 may coincide with a plane disposed generally perpendicular to the longitudinal axis 251 (see FIG. 3) and intersecting with the adapter 205 at a location at which the adapter 205 has its largest cross-sectional area.

The bottom surface 315 may comprise a generally planar front portion 316 disposed proximate to and extending rearwardly from the front surface 340 and a rear portion 317 extending rearwardly (e.g., in a direction from front end 206 towards rear end 208 of FIG. 3) from the front portion 316 toward the rear edge 380 of nose 250. The bottom surface 315 may provide a stable surface to act as a contact area during upload while reducing wear on the tip assembly 110 (see FIG. 3).

The top surface 330 of nose 250 may be configured to support the ground engaging tip 210 (see FIG. 3) during use of the implement 100 (see FIGS. 1-2) and to facilitate retention of the ground engaging tip 210 on the nose 250 when bearing a load of work material. The top surface 330 may include a plurality of surfaces as explained below.

As depicted in FIG. 5, the nose 250 may include surfaces such as a generally planar front side surface 305 disposed proximate to the front surface 340, a generally planar intermediate side surface 345 extending rearwardly (e.g., in a direction from front end 206 towards rear end 208 of FIG. 3) from the front side surface 305, and a rear side surface 350 extending rearwardly from the intermediate side surface 345 to the rear edge 380 of the nose 250.

The front surface 340 of the nose 250 may be planar as shown in FIGS. 4-6. In other embodiments (not shown) it may include a degree of curvature. As depicted in FIG. 4, front surface 340 may be hexagonally shaped comprising a bottom edge 341, opposing side edges 342 oriented at about 90° with respect to the bottom edge 341, a top horizontal edge 343 oriented about parallel to the bottom edge 341, and opposing top sloping edges 344 connecting the top horizontal edge 343 to the side edges 342. It is contemplated, however, that front surface may have a triangular, square, rectangular, circular, elliptical, polygonal, or any other shape.

As depicted in FIG. 6, nose 250 may also include a bottom rib 320 of the bottom surface 315. The bottom rib 320 of the bottom surface 315 may comprise a generally planar front rib portion 321 inclined downwardly relative to the bottom surface 315 and a generally planar rear rib portion 322 inclined downwardly (e.g., in a direction from top surface 330 towards bottom surface 315) relative to the front rib portion 321, between opposing rib side surfaces. The bottom rib 320 provides increased stability during side loading and increased wedging during push-on loading.

The side surfaces 335 of nose 250 may be generally planar and extend between the bottom surface 315 and the top surface 330. As depicted in FIG. 5, the side surfaces 335 may comprise a generally planar front side surface 331 disposed proximate to the front surface 340, a generally planar intermediate side surface 332 extending rearwardly from the front side surface 331, and a rear side surface 333 extending rearwardly from the intermediate side surface 332 to the rear edge 380 of the nose 250.

Side surfaces 335 may include a cutout 220. Cutout 220 may be designed to receive retainer block 230 (see FIG. 19). Cutout 220 may include surfaces designed to increase surface area contact between retainer block 230 and nose 250. By increasing surface area contact between the retainer block 230 and nose 250, the load applied when the tip assembly 110 (see FIG. 3) is in use may be distributed throughout the tip assembly 110. This may create a tight and stable connection between the adapter 205 and ground engaging tip 210, which may reduce wear on the tip assembly 110 throughout its use. (see FIG. 3). In some embodiments, each of side surfaces 335 may have a cutout 220 for installation of a retention mechanism 200. In other embodiments, only one of side surfaces 335 may have a cutout 220 for installation of the retention mechanism 200 (see FIG. 3).

As shown in FIGS. 4-6, cutout 220 may function with the retention mechanism 200 for maintaining the connection between the ground engaging tip 210 and the adapter 205. (see FIG. 3). Cutout 220 may have a complementary configuration to the retainer block 230 (see FIG. 19) such that the retainer block 230 may be installed in cutout 220 on one of the side surfaces 335. Cutout 220 may comprise a cutout height CH, cutout width CW, and cutout depth CD, as depicted in FIG. 5 and FIG. 6. Cutout width CW may be equal to cutout height CH or up to two times cutout height CH. Additionally, cutout width CW may range between ten percent of nose length NL and fifty percent of nose length NL. Cutout depth CD may range between ten percent of rear nose width RNW up to 100 percent of the rear nose width RNW.

Cutout 220 may comprise outer angled surfaces 390, inner side surfaces 391, inner rounded surfaces 392, and base surface 393, as depicted in FIG. 4 and FIG. 5. Referring to outer angled surfaces 390, these surfaces may provide an angled connection (such as a bevel) between side surface 335 and inner side surfaces 391 of cutout 220. Outer angled surfaces 390 may extend around an outer perimeter of inner side surfaces 391 of cutout 220. Outer angled surfaces 390 may further comprise a partially or fully rounded connection between the inner side surfaces 391 and side surface 335.

Cutout 220 may further comprise inner side surfaces 391, as depicted in FIG. 4. Inner side surfaces 391 may provide surface area contact between cutout 220 and the retainer block 230 (see FIG. 19). Inner side surfaces 391 may be located between outer angled surfaces 390 and inner rounded surfaces 392. Inner side surfaces 391 may define a perimeter of cutout 220 into which retainer block 230 may be inserted.

Figure 7:
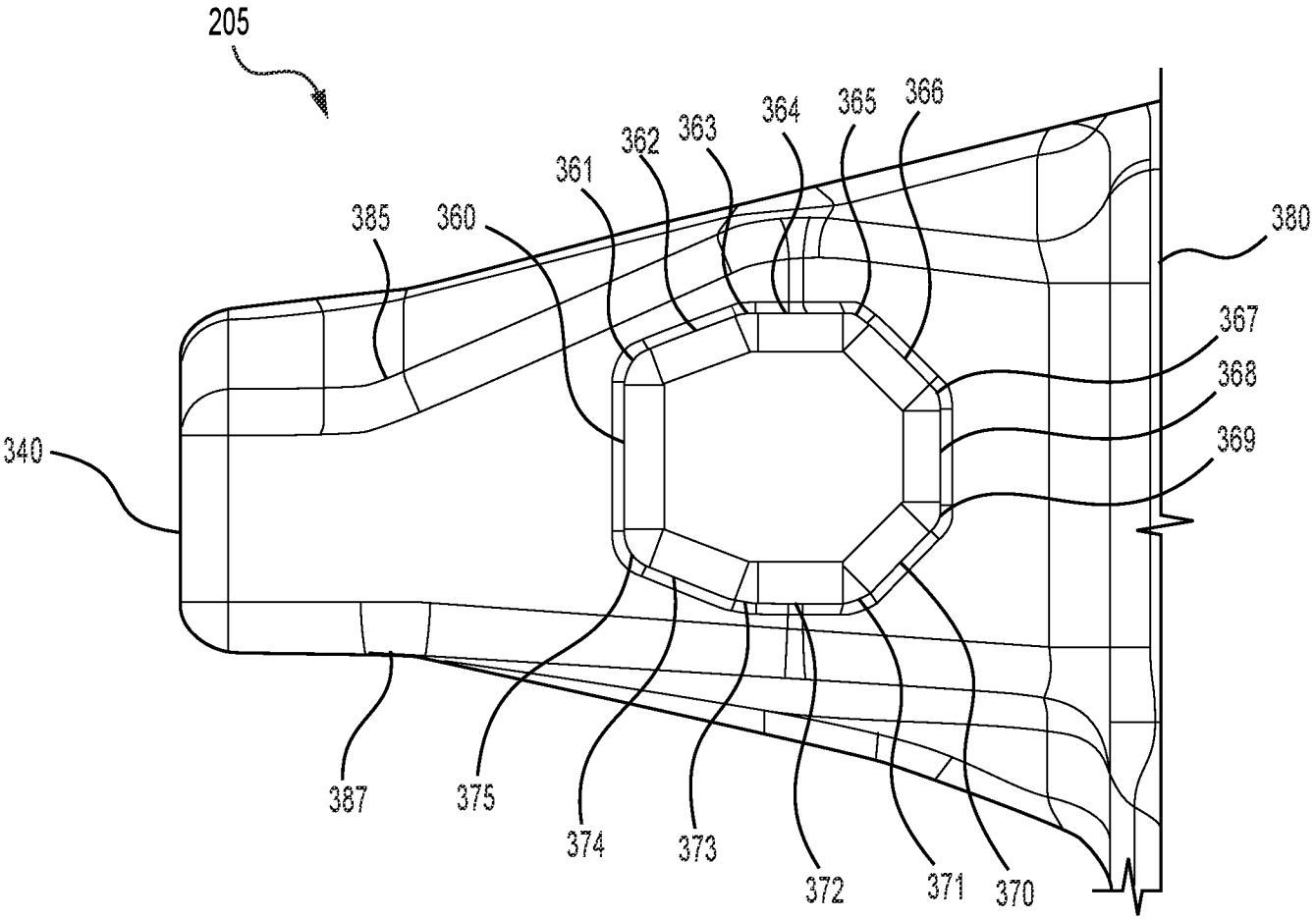
FIG. 7 is a side view of the nose of the adapter of FIG. 4.

As depicted in FIG. 7, the inner side surfaces 391 (see FIG. 4) may comprise front surface 360, front upper surface 362, upper surface 364, rear upper surface 366, rear surface 368, rear lower surface 370, lower surface 372, and front lower surface 374. The inner side surfaces 391 may further comprise transition side surfaces 361, 363, 365, 367, 369, 371, 373, and 375.

As depicted in FIG. 7, the inner side surfaces 391 may include a front surface 360. Front surface 360 may correspond to a contact surface 610 of the retainer block 230 (see FIG. 19). Front surface 360 may extend between transition side surface 361 and transition side surface 375. Front surface 360 may be planar and parallel to front surface 340. The tip assembly 110 (see FIG. 3) may experience peak loading forces in a direction towards front surface 340 and perpendicular to front surface 360. Therefore, front surface 360 may have relatively more surface area than other side surfaces. The increased surface area may allow the load applied to the tip assembly 110 to be distributed throughout tip assembly 110, which may reduce the wear on the tip assembly 110 during use. Front upper surface 362 may extend between transition side surface 361 and transition side surface 363. Front upper surface 362 may be parallel to rear side-sloping surface 385. Upper surface 364 may extend between transition side surface 363 and transition side surface 365. Rear upper surface 366 may extend between transition side surface 365 and transition side surface 367.

Rear surface 368 may extend between transition side surface 367 and transition side surface 369. Rear surface 368 may be planar and parallel to rear edge 380. The tip assembly 110 (see FIG. 3) may experience high loading forces in a direction towards the rear edge 380 and perpendicular to rear surface 368. The cutout 220 (see FIG. 4) may be located on side surface 335 of nose 250 to provide significant distance between rear surface 368 and rear edge 380 of nose 250. In particular, the distance between rear surface 368 and rear edge 380 of nose 250 may be more than one-half the overall width (measured from front surface 360 to rear surface 368) of cutout 220. By maximizing the surface area of side surface 335 between rear surface 368 and rear edge 380, the loads applied in a direction toward rear edge 380 may be distributed throughout the rear area of nose 250. This distribution may allow for consistent loading throughout the tip assembly 110 and may reduce wear on the tip assembly 110 during use. Rear lower surface 370 may extend between transition side surface 369 and transition side surface 371. Lower surface 372 may extend between transition side surface 371 and transition side surface 373. Front lower surface 374 may extend between transition side surface 373 and transition side surface 375.

Figure 8:
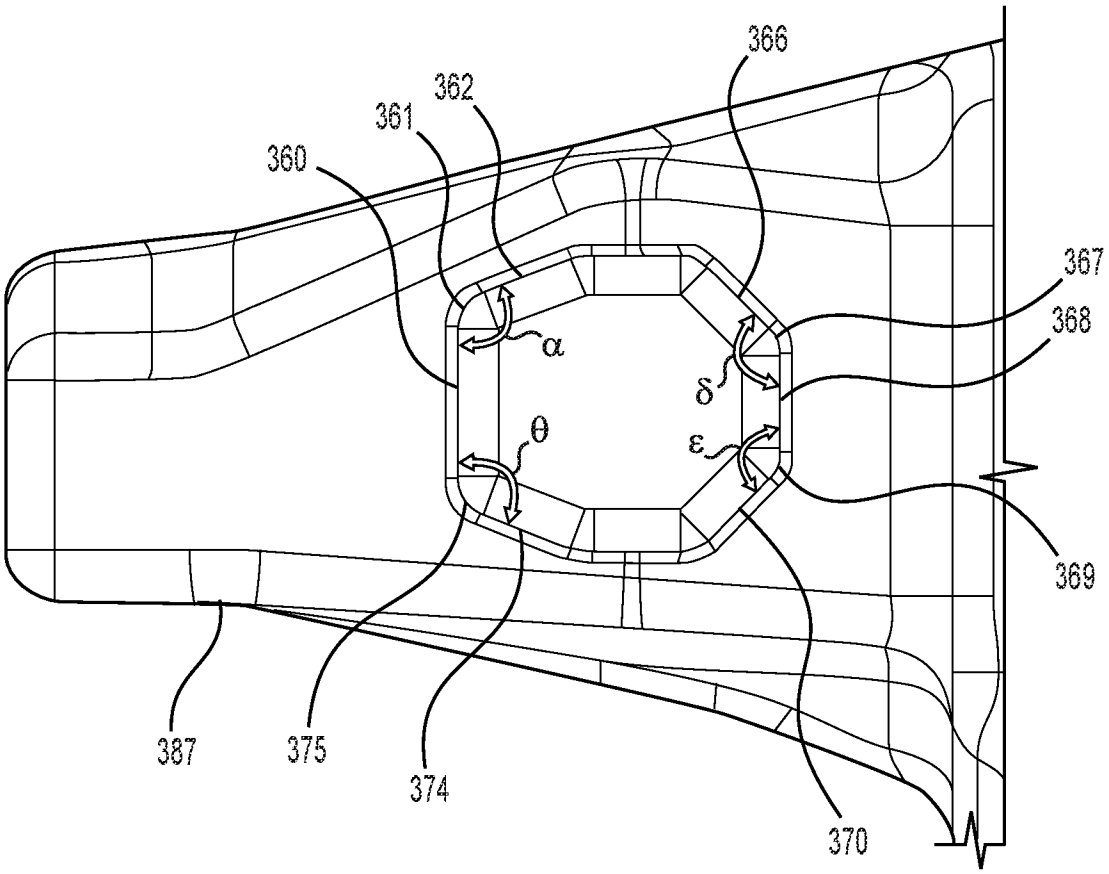
FIG. 8 is a side view of the nose of the adapter of FIG. 4.

As depicted in FIG. 8, the inner side surfaces 391 (see FIG. 4) may further comprise transition side surfaces 361, 367, 369, and 375. Front surface 360 may be connected to front upper surface 362 by transition side surface 361. As depicted in FIG. 8, transition side surface 361 may connect front surface 360 and front upper surface 362 at an angle $\alpha$ relative to each other. Angle $\alpha$ may range between 95° and 135°. In one exemplary embodiment as illustrated in FIG. 8, angle $\alpha$ may be 110°. Rear upper surface 366 may be connected to rear surface 368 by transition side surface 367. As depicted in FIG. 8, transition side surface 367 may connect rear upper surface 366 and rear surface 368 at an angle $\delta$ relative to each other. Angle $\delta$ may range between 120° and 150°. In one exemplary embodiment as illustrated in FIG. 8, angle $\delta$ may be 135°. Rear surface 368 may be connected to lower rear surface 370 by transition side surface 369. As depicted in FIG. 8, transition side surface 369 may connect rear surface 368 and lower rear surface 370 at an angle $\varepsilon$ relative to each other. Angle $\varepsilon$ may range between 120° and 150°. In one exemplary embodiment as illustrated in FIG. 8, angle $\varepsilon$ may be 135°. Front lower surface 374 may be connected to front surface 360 by transition side surface 375. As depicted in FIG. 8, transition side surface 375 may connect front lower surface 374 and front surface 360 at an angle $\theta$ relative to each other. Angle $\theta$ may range between 95° and 135°. In one exemplary embodiment as illustrated in FIG. 8, angle $\theta$ may be 110°. In some exemplary embodiments, angle $\alpha$ may be equal to angle $\theta$, and angle $\delta$ may be equal to angle $\varepsilon$.

Figure 9:
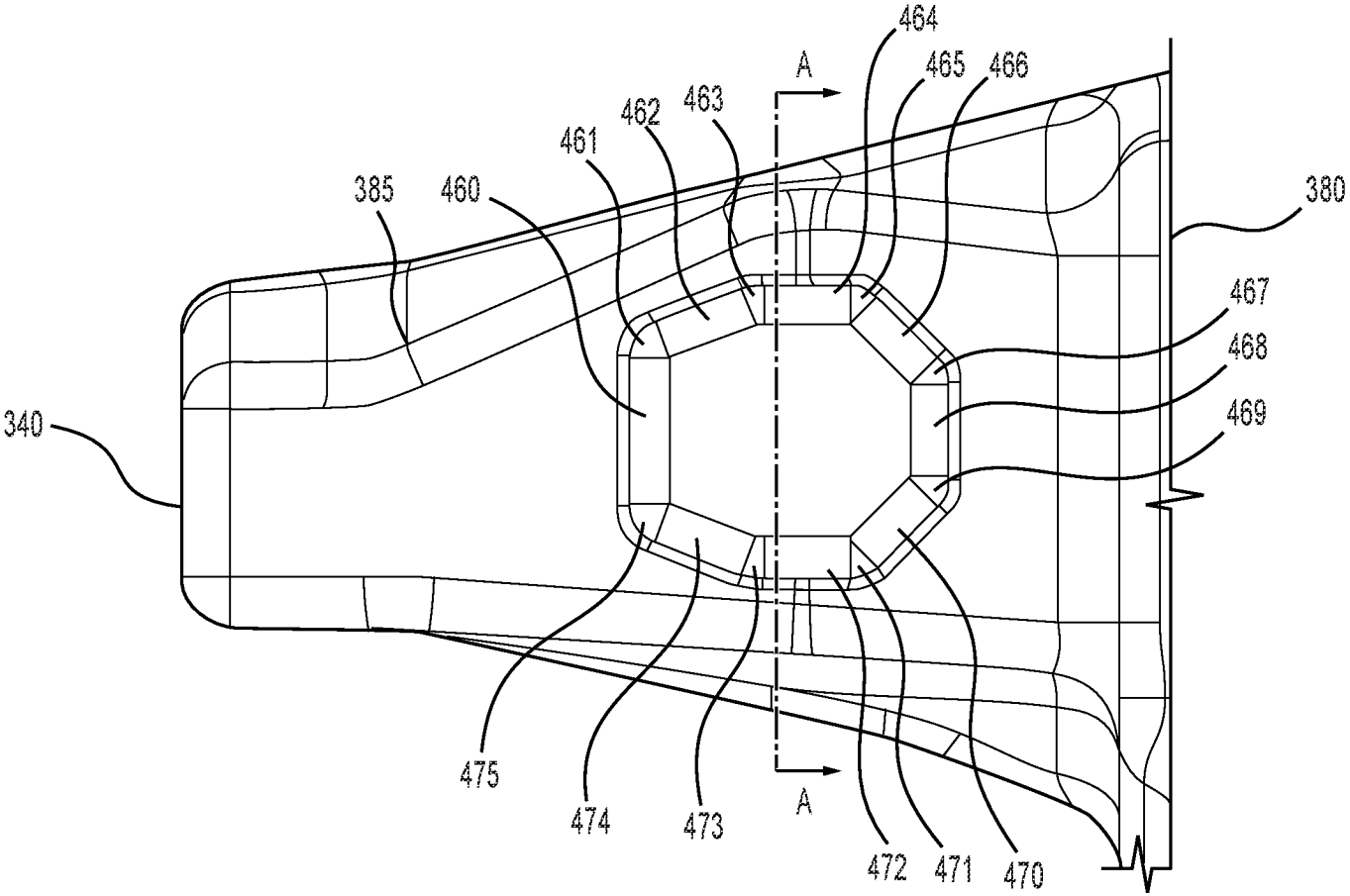
FIG. 9 is a side view of the nose of the adapter of FIG. 4.

Cutout 220 may further comprise inner rounded surfaces 392, as depicted in FIG. 4. Inner rounded surfaces 392 may provide additional surface area contact between cutout 220 and the retainer block 230 (see FIG. 19), thereby distributing forces throughout the tip assembly 110 (see FIG. 3) and reducing wear on the tip assembly 110 during use of the implement 100 (see FIGS. 1-2). Inner rounded surfaces 392 may provide a transition between the base surface 393 (see FIG. 5) and inner side surfaces 391. Inner rounded surfaces 392 may define an inner perimeter of cutout 220 around the base surface 393. As depicted in FIG. 9, the inner rounded surfaces 392 may comprise front rounded surface 460, front upper rounded surface 462, upper rounded surface 464, rear upper rounded surface 466, rear rounded surface 468, rear lower rounded surface 470, lower rounded surface 472, and front lower rounded surface 474. The inner rounded surfaces 392 may further comprise transition rounded surfaces 461, 463, 465, 467, 469, 471, 473, and 475.

Cutout 220 may further comprise base surface 393, as depicted in FIG. 5. Base surface 393 may comprise a planar surface recessed within cutout 220 for contact with the retainer block 230 (see FIG. 19). Base surface 393 may provide additional surface area contact between cutout 220 and the retainer block 230 to distribute forces throughout the tip assembly 110 (see FIG. 3). Base surface 393 may be recessed within side surface 335 of nose 250 at cutout depth CD. Base surface 393 may be defined by the perimeter of the inner rounded surfaces 392 (see FIG. 4).

Figure 10:
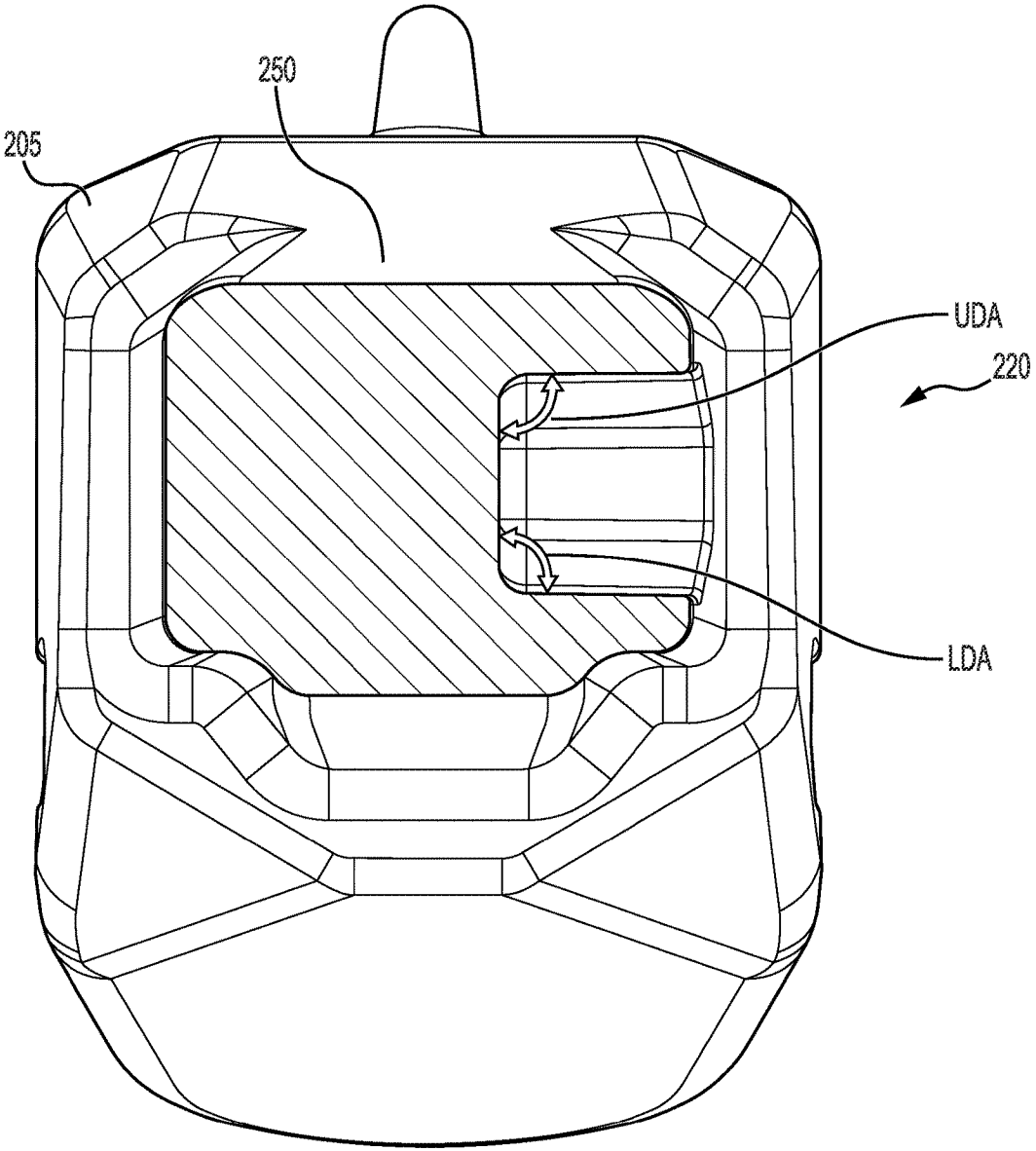
FIG. 10 is a cross-sectional view along line A-A of the nose of FIG. 9.
Figure 11:
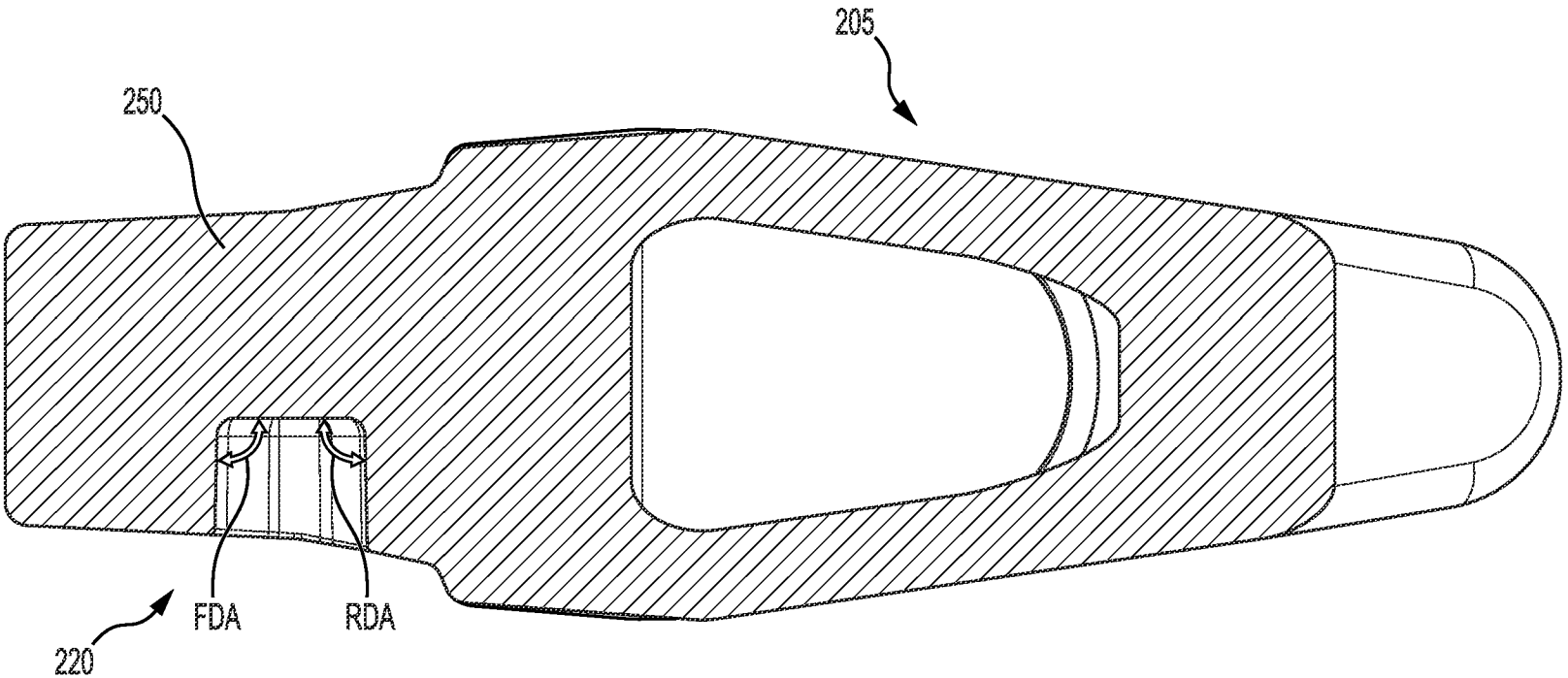
FIG. 11 is a cross-sectional view along line B-B of the adapter as shown in FIG. 3.

FIG. 10 illustrates a cross-sectional view along line A-A (see FIG. 9) of the nose 250. FIG. 11 illustrates a cross-sectional view along line B-B (see FIG. 3) of the adapter 205. Cutout 220 may further comprise an upper draft angle UDA, lower draft angle LDA, rear draft angle RDA, and forward draft angle FDA as depicted in FIGS. 10 and 11. Upper draft angle UDA and lower draft angle LDA may comprise angles ranging between 90° and 110°. In one exemplary embodiment as illustrated in FIG. 10, upper draft angle UDA and lower draft angle LDA may comprise an angle of 91°. Rear draft angle RDA and forward draft angle FDA may comprise angles ranging between 90° and 110°. In one exemplary embodiment as illustrated in FIG. 11, rear draft angle RDA and forward draft angle FDA may comprise an angle of 91°. While FIG. 10 and FIG. 11 depict upper draft angle UDA, lower draft angle LDA, rear draft angle RDA, and forward draft angle FDA, each of inner side surfaces 391 (see FIG. 4) may also comprise similar draft angles.

Figure 12:
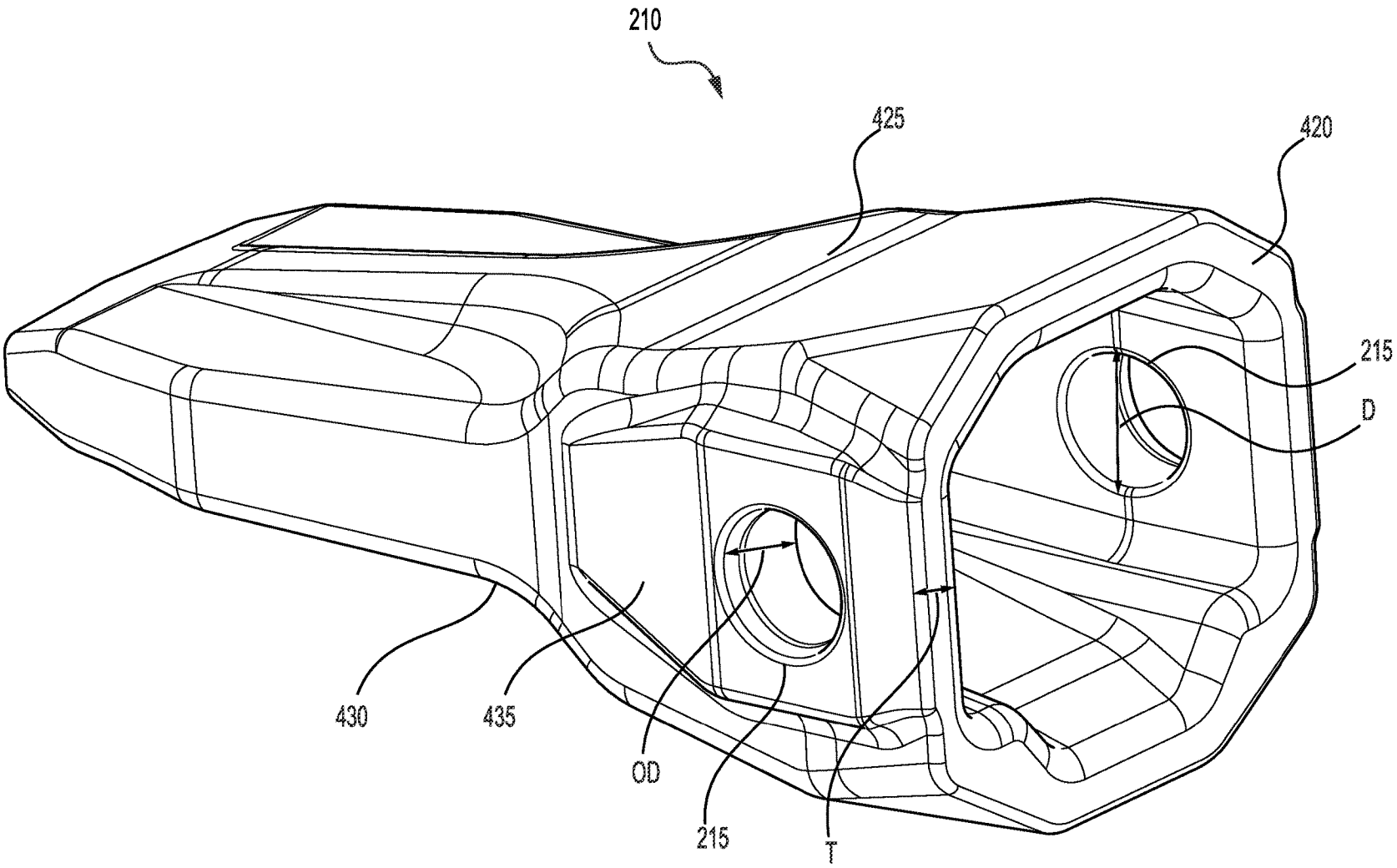
FIG. 12 is a rear isometric view of an exemplary ground engaging tip with openings.
Figure 15:
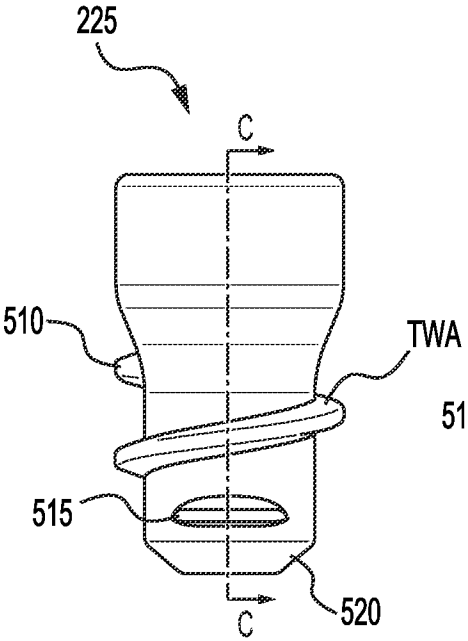
FIG. 15 is an isometric view of an exemplary retainer.
Figures 19, 20, 21, 22:
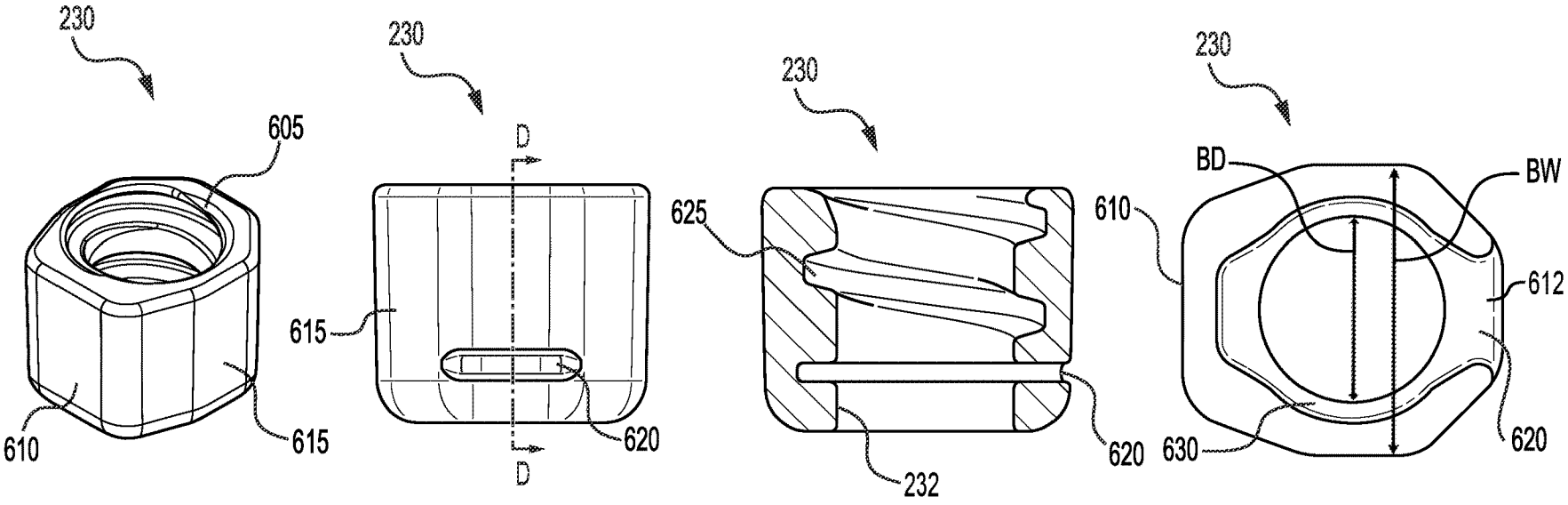
FIG. 19 is an isometric view of an exemplary retainer block.
FIG. 20 is a side view of the retainer block of FIG. 19.
FIG. 21 is a cross-sectional view of the retainer block along line D-D of FIG. 19.
FIG. 22 is a top view of the retainer block of FIG. 19.

FIG. 12 depicts ground engaging tip 210 with opening 215 for installation of the retainer 225 (see FIG. 15) into the retainer block 230 (see FIG. 19). The ground engaging tip 210 may be generally wedge-shaped and have a rear edge 420. The tip may have a top outer surface 425 extending forward from a top of the rear edge 420, and a bottom outer surface 430 extending forward from a bottom of the rear edge 420 of ground engaging tip 210. The top outer surface 425 may be angled downwardly, and the bottom outer surface 430 may be angled upwardly relative to the rear edge 420 such that the top outer surface 425 and the bottom outer surface 430 converge at a front edge at the front of the ground engaging tip 210. The ground engaging tip 210 may also include lateral outer surfaces 435 extending between the top outer surface 425 and the bottom outer surface 430 on either side of ground engaging tip 210.

Figure 13:
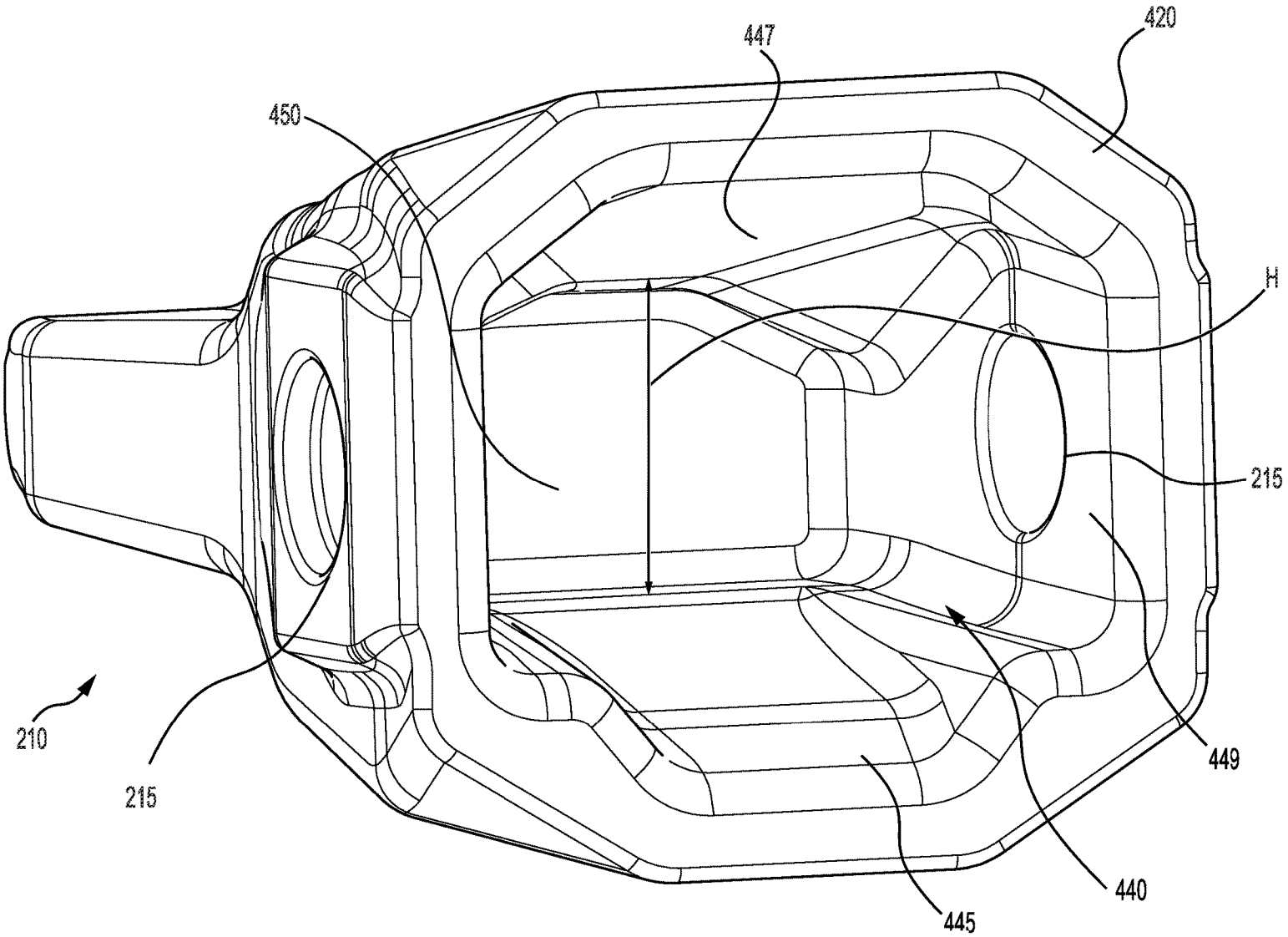
FIG. 13 is a depiction of an exemplary nose cavity of the ground engaging tip of FIG. 12.

As depicted in FIG. 12, lateral outer surfaces 435 of ground engaging tip 210 may include an opening 215 for receiving the retainer 225 (see FIG. 15) when ground engaging tip 210 is installed on the adapter 205 (see FIG. 3). Opening 215 may be a thru-hole through the lateral outer surfaces 435 of ground engaging tip 210. Ground engaging tip 210 may contain an opening 215 on both sides, as depicted in FIG. 12. In other embodiments, ground engaging tip 210 may contain one opening 215 on either the right lateral outer surface 435 or the left lateral outer surface 435 of ground engaging tip 210. Opening 215 may comprise an opening depth OD and diameter D. Opening depth OD may be the same depth as ground engaging tip thickness T or up to three times the depth of ground engaging tip thickness T. In one exemplary embodiment, as depicted in FIG. 12, opening depth OD may be twice the depth of ground engaging tip thickness T. Diameter D of opening 215 may range between 40 percent to 100 percent of height H, as depicted in FIG. 13. In one exemplary embodiment as depicted in FIG. 12 and FIG. 13, diameter D of opening 215 may be sixty percent of height H.

As depicted in FIG. 13, ground engaging tip 210 may be configured to be received onto the nose 250 (see FIG. 4). A nose cavity 440 may be defined within the ground engaging tip 210. The nose cavity 440 may have a complimentary configuration to receive the nose 250, and may include a bottom inner surface 445, a top inner surface 447, a pair of opposing side inner surfaces 449, and a front inner surface 450.

Figure 14:
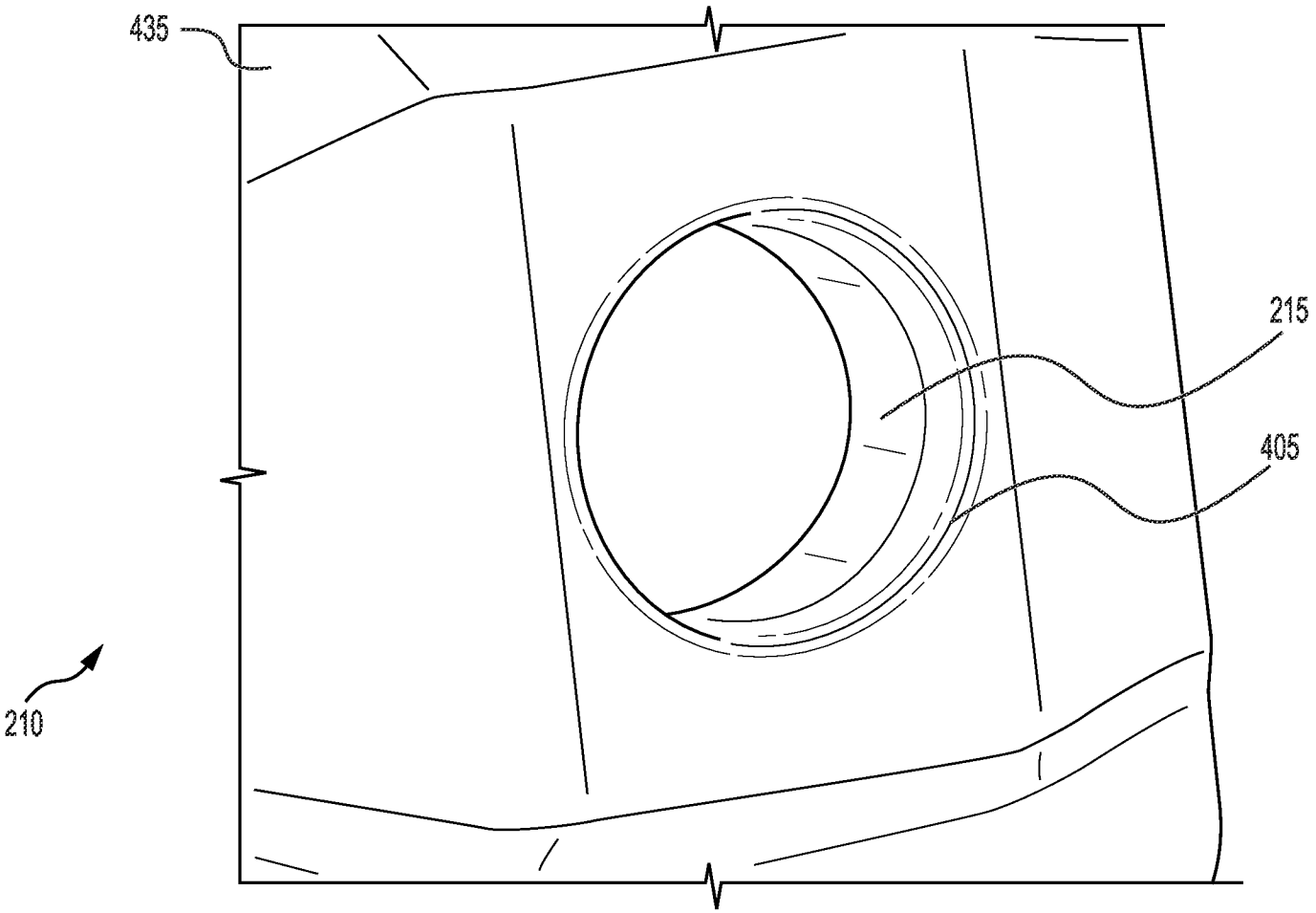
FIG. 14 is a depiction of an exemplary opening in the ground engaging tip of FIG. 12.

As depicted in FIG. 14, lateral outer surfaces 435 of ground engaging tip 210 may include an opening 215 for receiving the retainer 225 (see FIG. 15) when ground engaging tip 210 is installed on the adapter 205 (see FIG. 3). Opening 215 may be pre-seated to provide good contact with the retainer 225 while the retainer 225 is installed through opening 215 into the retainer block 230 (see FIG. 19). By increasing surface area contact between the retainer 225 and opening 215, loads applied to the tip assembly 110 (see FIG. 3) may be distributed between the retainer 225 and opening 215 of ground engaging tip 210. Opening 215 may also include drafted surface area 405 around the circumference of opening 215. Drafted surface area 405 may reduce surface contact during removal of the retainer 225 from the retainer block 230.

Figure 16:
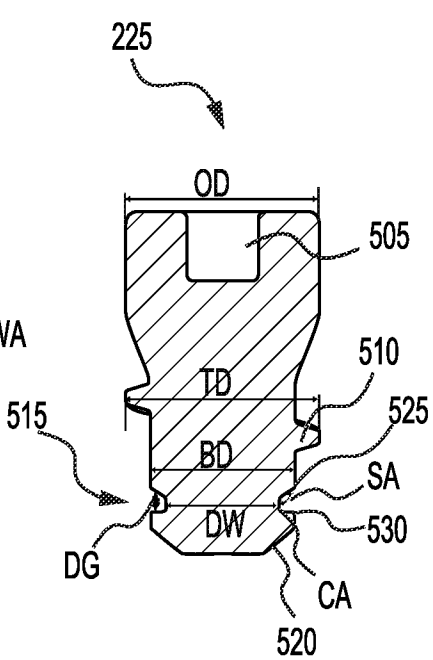
FIG. 16 is a cross-sectional view of the retainer of FIG. 15 along line C-C.

FIGS. 15-18 depict a retainer 225 for use in the retention mechanism 200 for maintaining a connection between the ground engaging tip 210 and the adapter 205. (See FIG. 3). FIG. 16 illustrates a cross-sectional view of the retainer 225 along line C-C(see FIG. 15). Retainer 225 may comprise an outer diameter OD, a thread diameter TD, a block diameter BD, and a detent width DW, as depicted in FIG. 16. In some embodiments, thread diameter TD may be at least ninety percent of outer diameter OD, but no more than the length of outer diameter OD. In some exemplary embodiments as depicted in FIG. 16, outer diameter OD of retainer 225 may be equal to thread diameter TD of retainer 225. In some exemplary embodiments, block diameter BD may be between fifty percent of outer diameter OD and ninety percent of outer diameter OD. In one exemplary embodiment as depicted in FIG. 16, block diameter BD may be seventy-five percent of outer diameter OD. In some exemplary embodiments, detent width DW may range between fifty percent of block diameter BD and ninety percent of block diameter BD. In one exemplary embodiment as depicted in FIG. 16, detent width DW may be eighty percent of block diameter BD.

Figure 17:
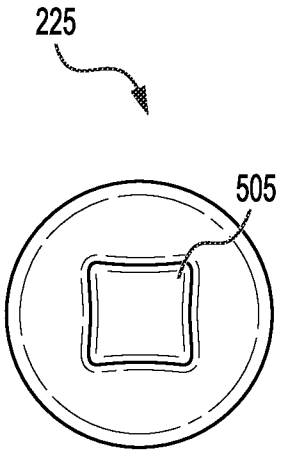
FIG. 17 is a top view of the retainer of FIG. 15.

Retainer 225 may further comprise a pocket 505, thread 510, detent cutouts 515, and chamfered bottom surface 520. As depicted in FIG. 17, retainer 225 may comprise a pocket 505. Pocket 505 may allow for rotation of retainer 225 using tools including, but not limited to, a flat head screwdriver, square drive, prybar, or any other tool suitable for rotating retainer 225. Pocket 505 may be of a size and shape to accept such tools, such that retainer 225 may be rotated into and out of the retainer block 230 (see FIG. 19). The square shape of pocket 505 may increase the ease with which an end user may remove retainer 225 from the retainer block 230. For example, dirt and debris may become stuck in the retention mechanism 200 during use of the tip assembly 110. (See FIG. 3). Because pocket 505 is square in shape, an impact hammer tool may be used to cut through dirt and debris stuck in the retention mechanism 200 and connect to square pocket 505 to remove retainer 225 from the retainer block 230. This may increase safety for an end user when disassembling the tip assembly 110 because the end user does not need specific tools to remove the retainer 225 from the retainer block 230 despite the dirt and debris that may be stuck in the retention mechanism 200.

Figure 18:
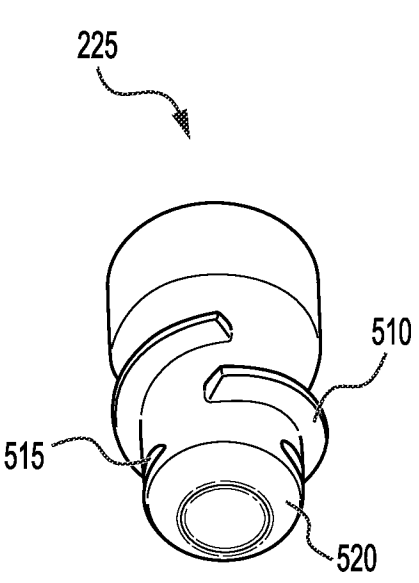
FIG. 18 is a lower isometric view of the retainer of FIG. 15.

Retainer 225 may further comprise thread 510. Thread 510 may be of a size and spacing such that thread 510 may rotate into the internal thread 625 of the retainer block 230 (see FIG. 21). For example, thread 510 may comprise a thread wrap angle TWA, that may represent an angle on a plane generally perpendicular to a longitudinal axis of retainer 225 between radial lines connecting the ends of thread 510. In some embodiments, thread wrap angle TWA may comprise a wrap angle ranging between 90° to 540°. In one exemplary embodiment as depicted in FIG. 18, thread wrap angle TWA may comprise a wrap angle of 360°. When retainer 225 is installed in the retainer block 230, thread 510 may interact with the internal thread 625 of the retainer block 230 to prevent linear movement of retainer 225 within the retainer block 230. Additionally, because thread 510 may have a thread wrap angle TWA between 90° and 540°, retainer 225 may be more easily removed from the retainer block 230. For example, dirt and debris may become wedged between the internal thread 625 of the retainer block 230 and thread 510 of retainer 225 which may cause increased friction force when removing retainer 225 from the retainer block 230. The use of one thread 510 with a thread wrap angle TWA between 90° and 540° decreases the amount of dirt and debris that may enter the retainer block 230, thereby decreasing the friction force caused by such dirt and debris when removing retainer 225 from the retainer block 230.

Retainer 225 may further include detent cutouts 515. As depicted in FIG. 16, retainer 225 may comprise two detent cutouts 515 positioned on opposite sides of retainer 225 under thread 510 and above chamfered bottom surface 520. Detent cutouts 515 may comprise notches in the body of retainer 225 that may be of a size and shape to allow the spring 235 (see FIG. 23) to retract into detent cutouts 515. For example, in some embodiments, detent gap DG may range between 0.5 mm and 25 mm. In one exemplary embodiment as depicted in FIG. 16, detent gap DG may be 2 mm. Detent cutouts 515 may interact with the spring 235 to prevent rotation of retainer 225 during use of the implement 100 (see FIGS. 1-2). The interaction between detent cutouts 515 and the spring 235 may also provide stability to retainer 225 if retainer 225 begins to move out of alignment from excess loading.

Detent cutouts 515 may comprise lower surface 530 and angled upper surface 525 as depicted in FIG. 16. Lower surface 530 may prevent retainer 225 from moving linearly out of the retainer block 230 (see FIG. 19) by deflecting the spring 235 (see FIG. 23) to unlock from its locked position. Lower surface 530 may comprise a capture angle CA. Capture angle CA may comprise an angle ranging between 90° and 135°. In one exemplary embodiment as depicted in FIG. 16, capture angle CA may comprise an angle of 90°. During use of the tip assembly 110 (see FIG. 3), retainer 225 may experience forces that push it into the retainer block 230. Angled upper surface 525 may provide a gap between retainer 225 and the top edge of the spring 235 such that retainer 225 may move further into the retainer block 230 without causing increased stress on retainer 225 or the retainer block 230. Angled upper surface 525 may comprise a stabilization angle SA. Stabilization angle SA may comprise an angle ranging between 90° and 135°. In one exemplary embodiment as depicted in FIG. 16, stabilization angle SA may comprise an angle of 124°.

As depicted in FIG. 18, retainer 225 may also comprise chamfered bottom surface 520. Chamfered bottom surface 520 may be angled inwardly as it extends downward. Chamfered bottom surface 520 may aid in the installation of retainer 225 within the retainer block 230 (see FIG. 19). For example, chamfered bottom surface 520 may deflect the spring 235 (see FIG. 23) as retainer 225 is rotated into the retainer block 230. After retainer 225 is rotated into place in the retainer block 230, the spring 235 may engage detent cutouts 515 of retainer 225 to prevent further rotation of retainer 225.

FIGS. 19-22 illustrate a retainer block 230 for use in the retention mechanism 200 for maintaining a connection between the ground engaging tip 210 and the adapter 205. (See FIG. 3). As depicted in FIG. 19, retainer block 230 may have a cavity 232 configured to receive retainer 225, as further explained below. Retainer block 230 may also have an outer surface 234. Outer surface 234 may define a contact surface 610 on one side of retainer block 230, a back surface 612 on an opposing side of retainer block 203, and angled surfaces 615 located between contact surface 610 and back surface 612. Contact surface 610 may be flat and may increase surface area contact between retainer block 230 and the side surface 335 of the nose 250 (see FIG. 4). The increased surface area contact between retainer block 230 and the side surface 335 of the nose 250 may allow for distribution of loads throughout the tip assembly 110 (see FIG. 3), thus reducing the wear on both retainer block 230 and the adapter 205.

The outer surface of retainer block 230 may further include angled surfaces 615 that are angled relative to contact surface 610. Angled surfaces 615 of retainer block 230 may distribute multi-directional loading forces throughout the adapter 205 (see FIG. 3) and retainer block 230. Angled surfaces 615 may be of such a size, angle, and length to maximize available surface area on the side surface 335 of the adapter 205. For example, angled surfaces 615 may correspond to the inner side surfaces 391 and the inner rounded surfaces 392 of the cutout 220. (See FIG. 4). Increasing surface area contact between angled surfaces 615 and the cutout 220 may distribute loading forces throughout the tip assembly 110 which may reduce wear and damage to retainer block 230, the adapter 205, and the ground engaging tip 210. (See FIG. 3).

As depicted in FIG. 19, retainer block 230 may include a drafted cylindrical surface area 605. Drafted cylindrical surface area 605 may reduce surface area contact between retainer block 230 and the retainer 225 (see FIG. 15). This reduction in surface area contact resulting from the drafted cylindrical surface area 605 may aid in the removal of the retainer 225 from retainer block 230.

As depicted in FIG. 22, the outer surface of retainer block 230 may further comprise back surface 612 opposite contact surface 610. A slot 620 may pass through back surface 612 for insertion of the spring 235 (see FIG. 23). Thus, slot 620 may be located through the surface of retainer block 230 opposite contact surface 610. Slot 620 may be of a height and width to allow the spring 235 to be installed therein. For example, a height of slot 620 may be greater than the cross-sectional thickness XT of the spring 235. A width of slot 620 may be greater than a width of the front portion 705.

FIG. 21 illustrates a cross-sectional view of the retainer block 230 along line D-D as shown in FIG. 19. As depicted in FIG. 21, retainer block 230 may comprise internal thread 625 located within cavity 232. Internal thread 625 of retainer block 230 may correspond to the thread 510 of the retainer 225 (see FIG. 15). During installation, the retainer 225 may be rotated into retainer block 230 and internal thread 625 of retainer block 230 may engage with the thread 510 of the retainer 225. Internal thread 625 may prevent linear movement of the retainer 225 out of or into retainer block 230 during operation. Additionally, the use of a single internal thread 625 may minimize the amount of dirt and debris that may enter retainer block 230 during use of the tip assembly 110 (see FIG. 3). Minimizing the dirt and debris between internal thread 625 and the thread 510 may reduce friction forces when an end user removes the retainer 225 from retainer block 230.

As depicted in FIG. 22, retainer block 230 may comprise a cutout 630 within the body of retainer block 230. Cutout 630 may be coplanar with slot 620. Cutout 630 may provide space within retainer block 230 to allow the spring 235 (see FIG. 23) to deflect when the retainer 225 (see FIG. 15) is being installed into retainer block 230. The spring 235 may deflect from its resting position into cutout 630 as the retainer 225 is being installed in retainer block 230 and the spring 235 may retract from cutout 630 and engage with the detent cutouts 515 of the retainer 225 after the retainer 225 is installed in retainer block 230.

As further depicted in FIG. 22, retainer block 230 may comprise a block diameter BD and a block width BW. Block diameter BD may range between thirty percent of block width BW and ninety percent of block width BW. In one exemplary embodiment as depicted in FIG. 22, block diameter BD may be sixty percent of block width BW.

Figure 23:
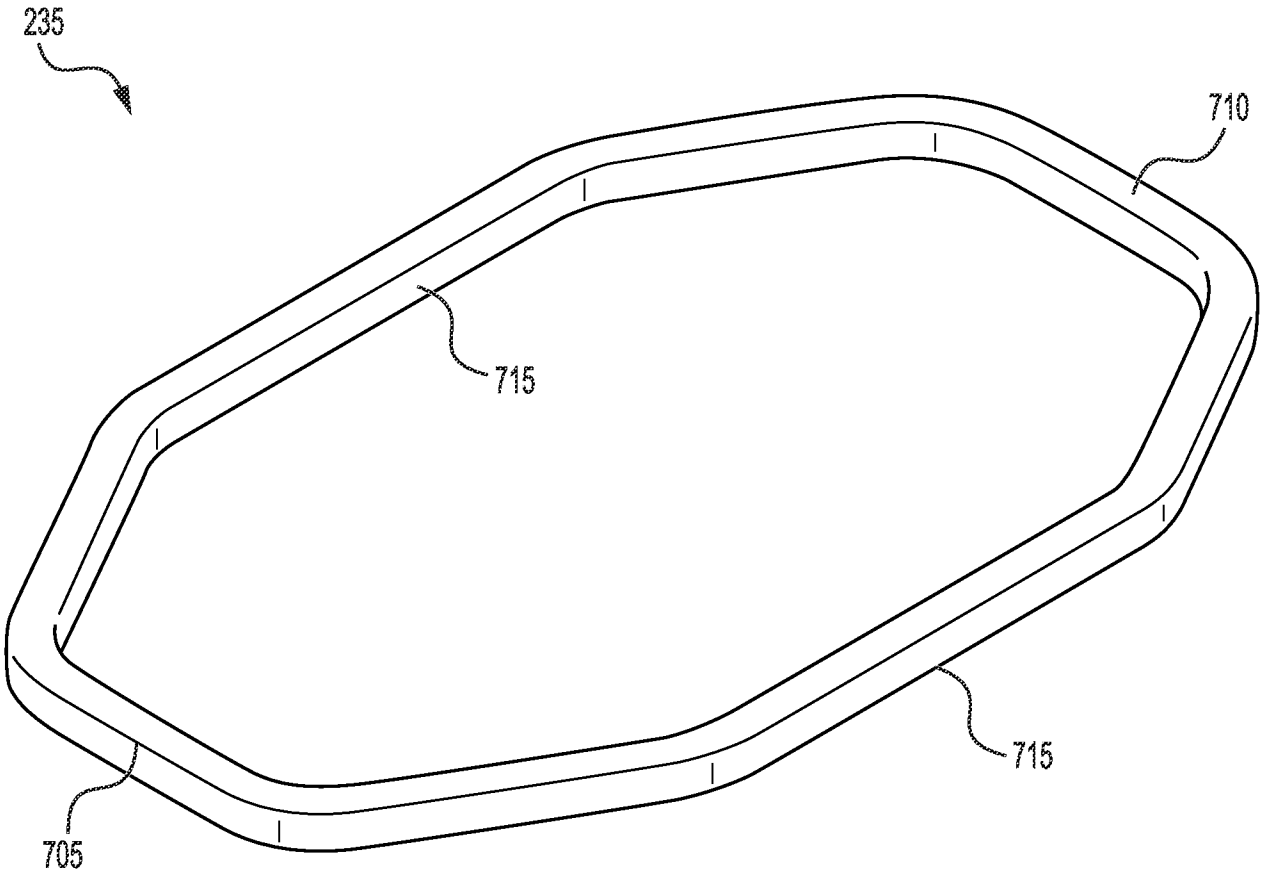
FIG. 23 is an isometric view of an exemplary spring.

FIG. 23 illustrates an exemplary embodiment of spring 235. Spring 235 may be installed within the retainer block 230 through the slot 620 (see FIG. 20). Spring 235 may interact with the detent cutouts 515 of the retainer 225 (see FIG. 15) when the retainer 225 is installed within the retainer block 230. Such interaction of spring 235 and the retainer 225 may prevent rotation of the retainer 225 during use of the tip assembly 110 (see FIG. 3). Spring 235 may comprise a front portion 705, a rear portion 710, and side portions 715. Front portion 705 may be narrower than rear portion 710. Narrowed front portion 705 may aid in installing spring 235 into the retainer block 230 through the slot 620. When spring 235 is installed in the retainer block 230, larger rear portion 710 may snap into place, which may prevent the spring 235 from exiting the retainer block 230 through the slot 620. Spring 235 may further include side portions 715. Side portions 715 may interact with the detent cutouts 515 of the retainer 225 to prevent rotation of the retainer 225 during operation of the tip assembly 110. A cross section of spring 235 may be square, rectangular, round, or elliptical in shape, or may have any other shape.

Figure 25:
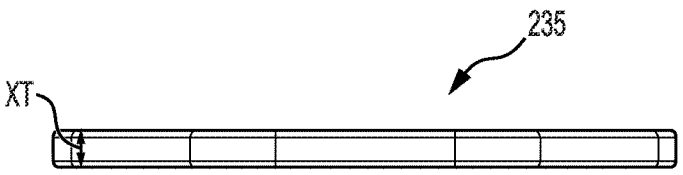
FIG. 25 is a side view of the spring of FIG. 23.
Figure 24:
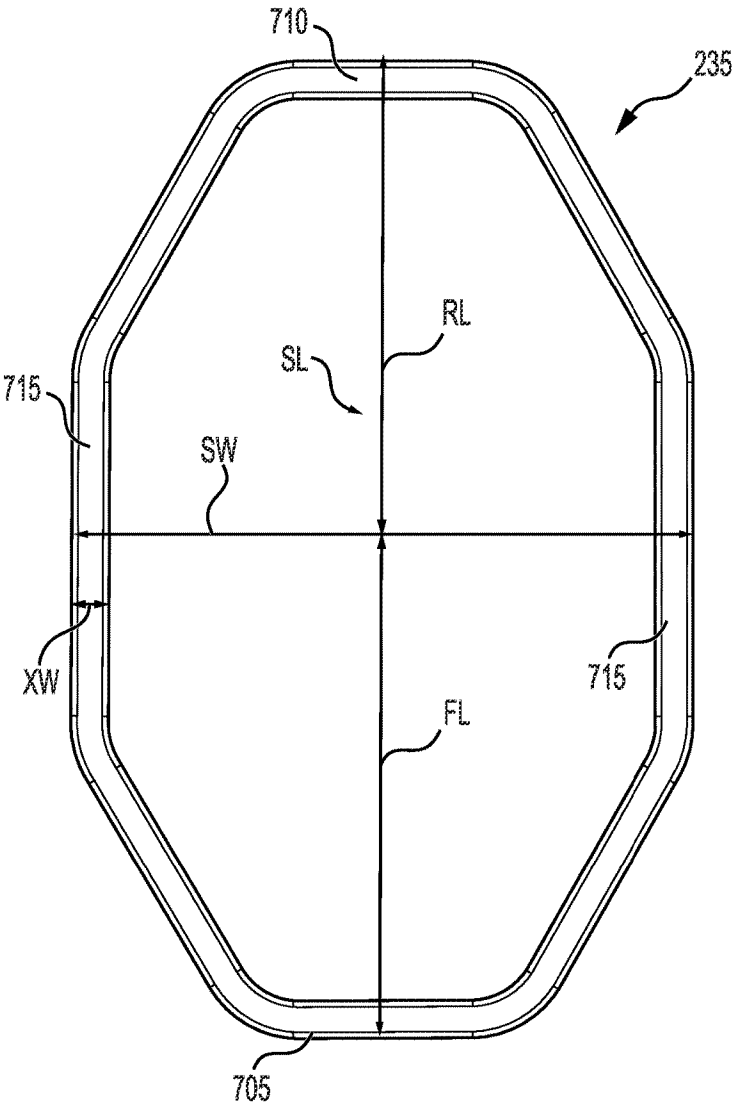
FIG. 24 is a top view of the spring of FIG. 23.
Figure 26:
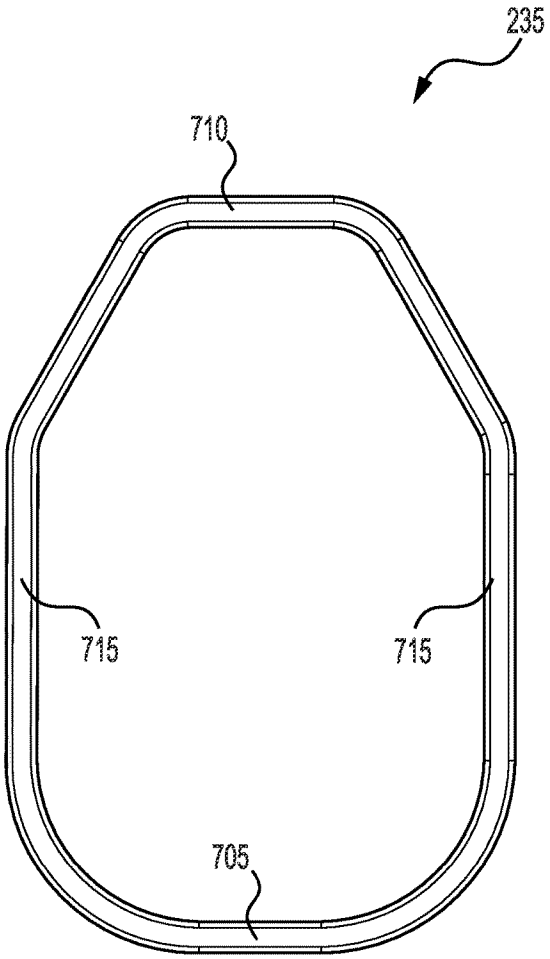
FIG. 26 is a top view of an exemplary spring with a flat front portion and rounded edges.
Figure 29:
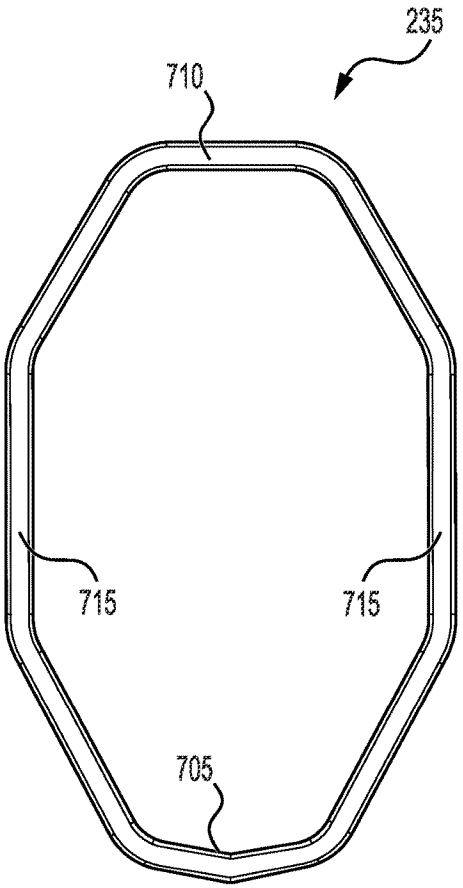
FIG. 29 is a top view of an exemplary spring with a convex front portion.
Figure 28:
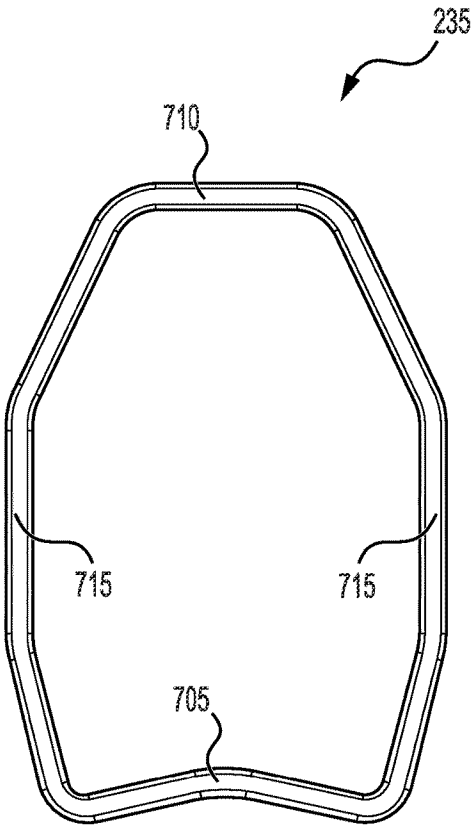
FIG. 28 is a top view of an exemplary spring with a concave front portion.
Figure 27:
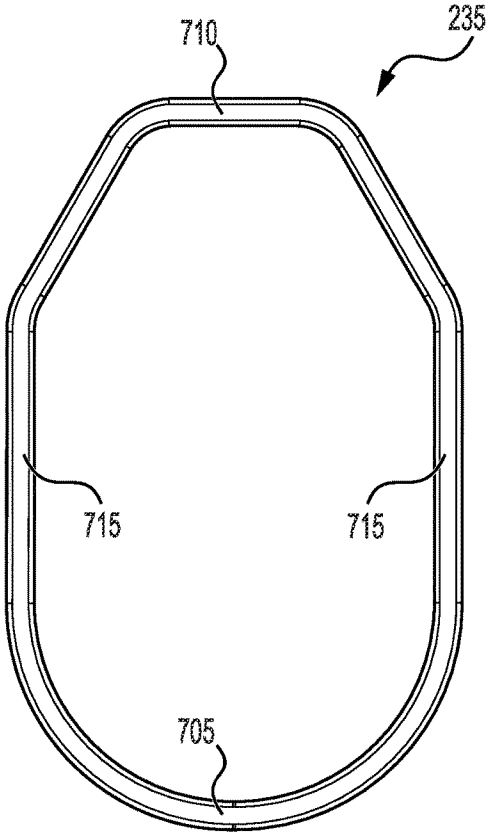
FIG. 27 is a top view of an exemplary spring with a rounded front portion.

Spring 235 may comprise a spring length SL, spring width SW, cross-sectional width XW, cross-sectional thickness XT, front length FL, and rear length RL, as depicted in FIGS. 24 and 25. Spring length SL may be a length ranging between the spring width SW and four times the spring width SW. In one exemplary embodiment as depicted in FIG. 24, spring length SL may be 1.5 times spring width SW. Cross-sectional width XW may range between 0.5 mm and 12 mm. In one exemplary embodiment as depicted in FIG. 24, cross-sectional width XW may be 1.5 mm. Cross-sectional thickness XT may range between 0.5 mm and 12 mm. In one exemplary embodiment as depicted in FIG. 25, cross-sectional thickness XT may be 1.5 mm. A forward length FL of spring 235 may be equal to the length of rear length RL and no more than two times the length of rear length RL. In one exemplary embodiment as depicted in FIG. 24, front length FL may be equal to rear length RL.

As depicted in FIGS. 26-29, the shape of front portion 705 or rear portion 710 may comprise a variety of shapes. As depicted in FIGS. 26-29, front portion 705 may be flat, rounded, concave, or convex in shape. The shape of front portion 705 and rear portion 710 of spring 235 may be determined based on a desired flexibility and rigidity ratio or manufacturing flexibility. Although FIGS. 26-29 depict front portion 705 as flat, rounded, concave, or convex in shape, rear portion 710 may also be flat, rounded, concave, or convex in shape. Any combination of shapes as depicted on FIGS. 26-29 for front portion 705 and rear portion 710 may be used to provide the desired level of flexibility for spring 235.

Figure 30:
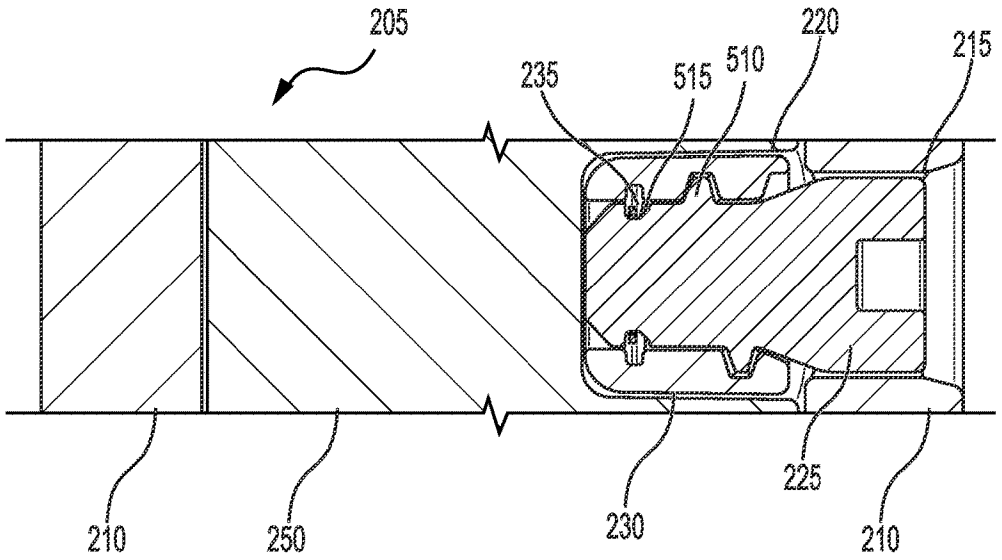
FIG. 30 is a cross-sectional view, along line E-E of FIG. 36, of an exemplary retention mechanism installed within the tip assembly of FIG. 3.
Figure 36:
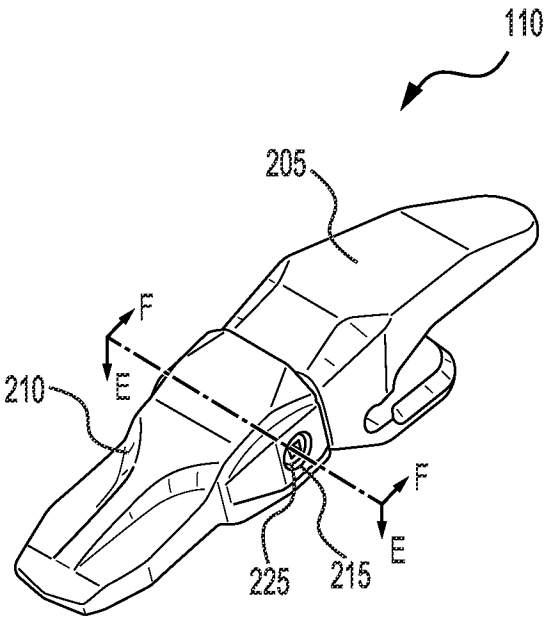
FIGS. 34-36 depict installation of the tip assembly of the FIG. 3 with the retention mechanism of FIG. 15.

FIG. 30 depicts a section view, taken along the line E-E as depicted in FIG. 36, of retainer block 230 and retainer 225 installed within adapter 205 and ground engaging tip 210. As shown in FIG. 30, retainer block 230 is installed within cutout 220 of adapter 205. Ground engaging tip 210 is installed over nose 250 of adapter 205 and retainer 225 is installed in retainer block 230 through opening 215 of ground engaging tip 210. Spring 235 may be interlocked with detent cutouts 515 of retainer 225. This interconnection of spring 235 and detent cutouts 515 may prevent rotation of retainer 225 within retainer block 230 when the tip assembly 110 (see FIG. 3) is in use.

Figure 31:
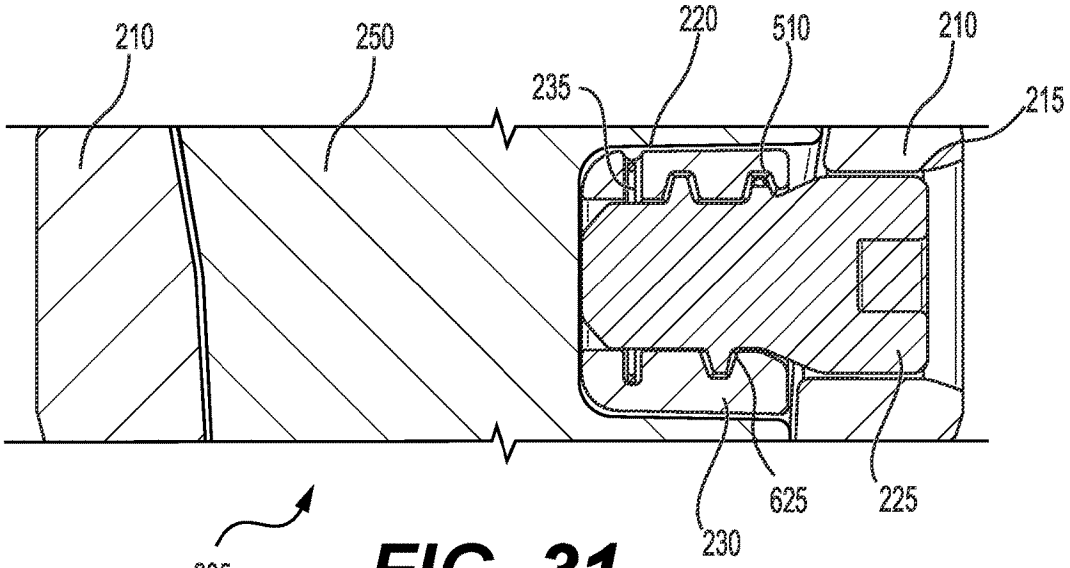
FIG. 31 is a cross-sectional view, along line F-F of FIG. 36, of the retention mechanism of FIG. 30 installed within the tip assembly of FIG. 3.

FIG. 31 depicts a section view, taken along the line F-F as depicted in FIG. 36, of retainer block 230 and retainer 225 installed within adapter 205 and ground engaging tip 210. As shown in FIG. 31, retainer block 230 is installed within cutout 220 of adapter 205. Ground engaging tip 210 is installed over nose 250 of adapter 205 and retainer 225 is installed in retainer block 230 through opening 215 of ground engaging tip 210. Thread 510 may interact with internal thread 625 to prevent linear movement of retainer 225 within retainer block 230 when the tip assembly 110 (see FIG. 3) is in use. Additionally, as shown in FIG. 31, opening 215 of ground engaging tip 210 may be pre-seated to provide maximum contact between retainer 225 and opening 215. This contact may prevent movement of retainer 225 within retainer block 230 when the tip assembly 110 is in use.

Figure 32:
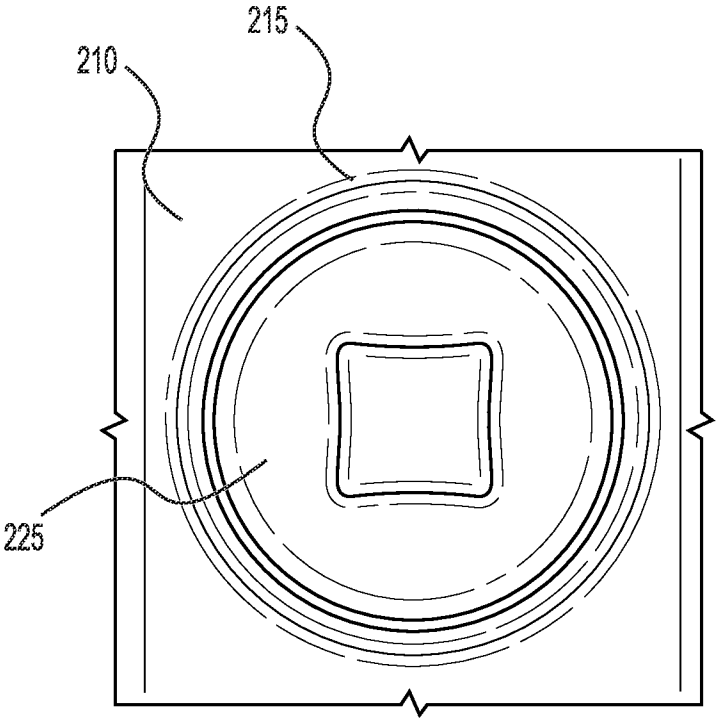
FIG. 32 is a front view of the retainer of FIG. 15 installed within the tip assembly of FIG. 3.

FIG. 32 depicts a front view of retainer 225 installed within opening 215 of ground engaging tip 210. The inner diameter of opening 215 may correspond to the outer diameter of retainer 225, such that retainer 225 may be installed within opening 215 while maintaining surface contact between retainer 225 and opening 215.

Figure 33:
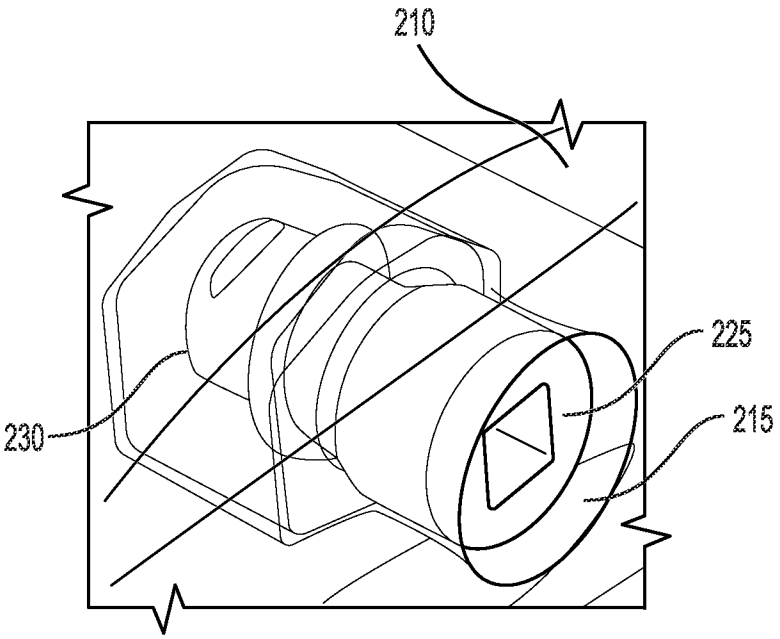
FIG. 33 is a three-dimensional rendering of the retention mechanism of FIG. 30 installed within the tip assembly of FIG. 3.

FIG. 33 depicts a three-dimensional rendering of retainer 225 installed within retainer block 230 through opening 215 of ground engaging tip 210. As depicted in FIG. 33, retainer 225 may be recessed in opening 215 of ground engaging tip 210 to protect retainer 225 from outside force while the tip assembly 110 (see FIG. 3) is in use.

INDUSTRIAL APPLICABILITY

Figure 35:
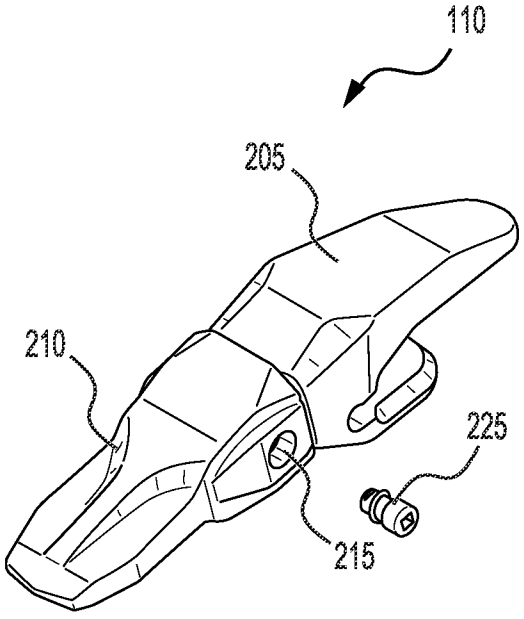
Figure 34:
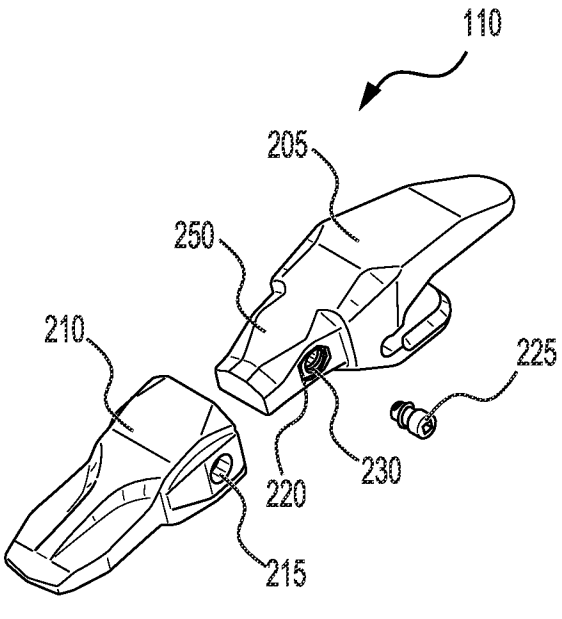

FIGS. 34-36 depict a method for assembling tip assembly 110. The spring 235 (see FIG. 23) may be installed within retainer block 230 through the slot 620 (see FIG. 20). As shown in FIG. 34, retainer block 230 with the spring 235 may be inserted into cutout 220 of adapter 205. As shown in FIG. 34 and FIG. 35, after installing retainer block 230 in cutout 220 of adapter 205, ground engaging tip 210 may be installed over nose 250 of adapter 205. Ground engaging tip may include the nose cavity 440 (see FIG. 13) that is complementary to the size and shape of nose 250, such that the nose 250 of adapter 205 may be placed within the nose cavity 440 of ground engaging tip 210. As shown in FIG. 36, retainer 225 may be installed within retainer block 230 through opening 215 of ground engaging tip 210. Retainer 225 may be installed within retainer block 230 by rotating retainer 225 such that the thread 510 (see FIG. 15) of the retainer 225 may interconnect with the internal thread 625 (see FIG. 21) of the retainer block 230. As retainer 225 is installed within retainer block 230, the chamfered bottom surface 520 of the retainer 225 may deflect the spring 235 into the cutout 630 (see FIG. 22) of the retainer block 230. Once retainer 225 is fully installed within retainer block 230, the spring 235 may engage with the detent cutouts 515 of the retainer 225. After retainer 225 is locked within retainer block 230, the retention mechanism 200 (see FIG. 3) may maintain the connection between adapter 205 and ground engaging tip 210 during use of the implement 100 (see FIGS. 1-2).

The tip assembly 110 may be disassembled by reversing the steps as shown in FIGS. 34-36. FIG. 36 depicts tip assembly 110 in its assembled form with retainer 225 installed within retainer block 230 through opening 215 of ground engaging tip 210. Retainer 225 may be removed from retainer block 230 through opening 215 of ground engaging tip 210, as depicted in FIG. 35. Retainer 225 may be removed by rotating retainer 225 out of retainer block 230 using tools including, but not limited to, a flat head, square drive, prybar, or any other tool suitable for rotating retainer 225. Such tools may be used to engage with the pocket 505 (see FIG. 17) of the retainer 225 to rotate retainer 225 out of retainer block 230. Ground engaging tip 210 may then be removed from nose 250 of adapter 205, as shown in FIG. 34.

Figure 38:
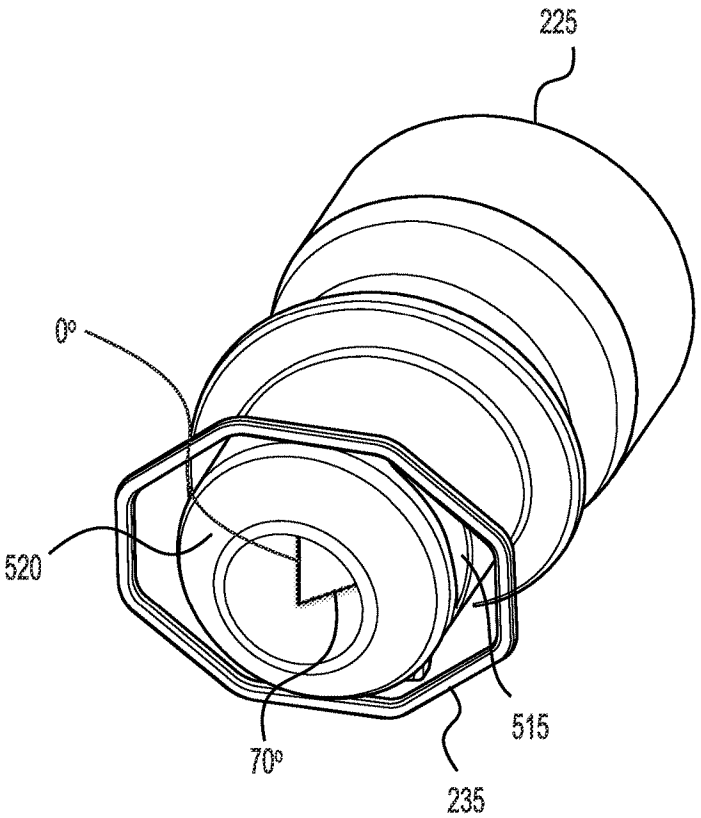
FIGS. 37-40 are isometric views of the retention mechanism of FIG. 30 depicting a deflection of the spring of FIG. 23 as the retainer of FIG. 15 is installed within the retainer block of FIG. 19.
Figure 37:
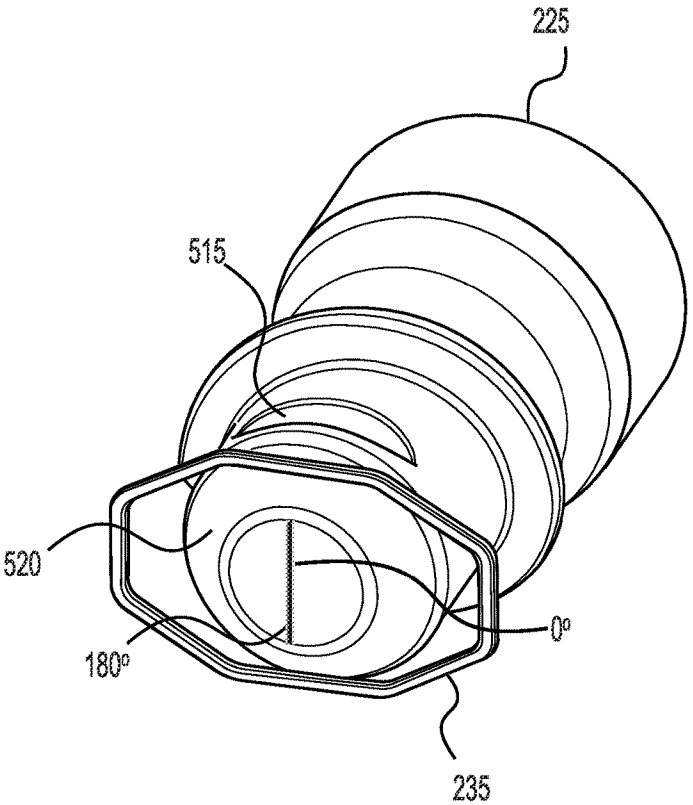
Figure 40:
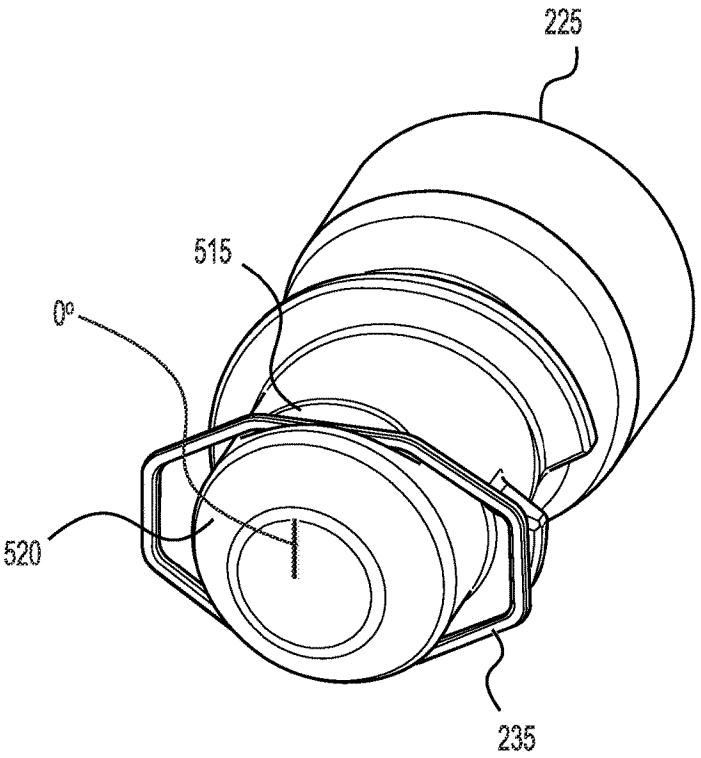
Figure 39:
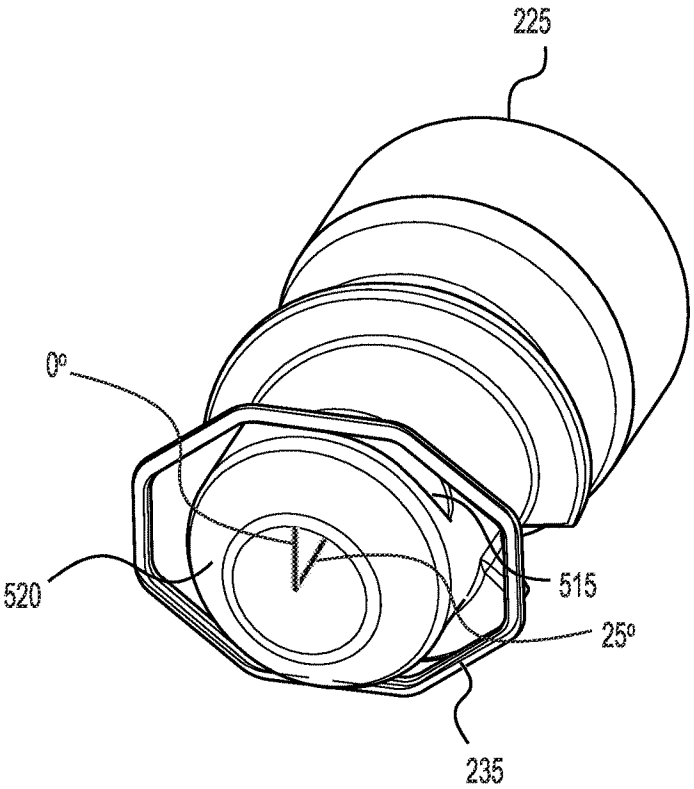

FIGS. 37-40 depict a deflection pattern of spring 235 when retainer 225 is being installed in the retainer block 230 (see FIG. 19). FIG. 37 depicts retainer 225 in a 180° position, where a 0° position represents retainer 225 in its locked position. At the 180° position, spring 235 may be in a natural resting position as chamfered bottom surface 520 begins to interact with spring 235. Chamfered bottom surface 520 may begin to deflect spring 235 as retainer 225 is rotated into the retainer block 230. FIG. 38 depicts retainer 225 in a 70° position. As depicted in FIG. 38, spring 235 may be in a deflected position as chamfered bottom surface 520 has rotated past spring 235. Spring 235 may begin interacting with the edges of detent cutouts 515. FIG. 39 depicts retainer 225 in a 25° position. As depicted in FIG. 39, spring 235 may be in a deflected position as retainer 225 continues to rotate such that spring 235 may be increasing contact with detent cutouts 515. FIG. 40 depicts retainer 225 in a 0° locked position. In this position, retainer 225 is fully installed within the retainer block 230 and spring 235 has fully engaged detent cutouts 515. As depicted in FIG. 40, spring 235 may no longer be deflected and may be locked within detent cutouts 515. When in the locked position as depicted in FIG. 40, detent cutouts 515 may interact with spring 235 to prevent rotation of retainer 225 during use of the implement 100 (see FIGS. 1-2). The locked position of FIG. 40 may also provide stability to retainer 225 if retainer 225 begins to move out of alignment from excess loading.

Figure 41:
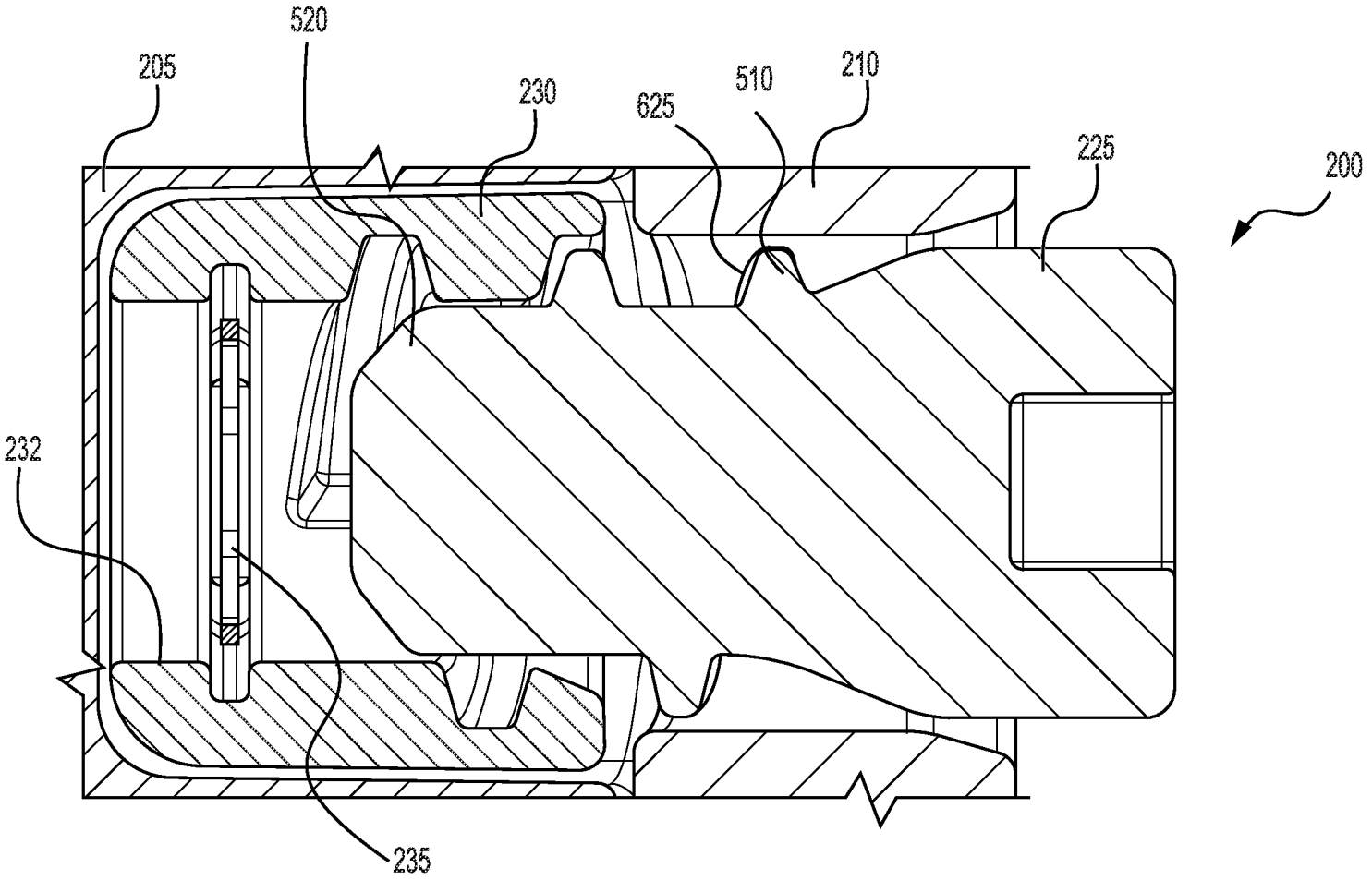
FIGS. 41-46 are cross-sectional views of the retention mechanism of FIG. 30, along line E-E of FIG. 36, as the retainer of FIG. 15 is being installed within the retainer block of FIG. 19.
Figure 42:
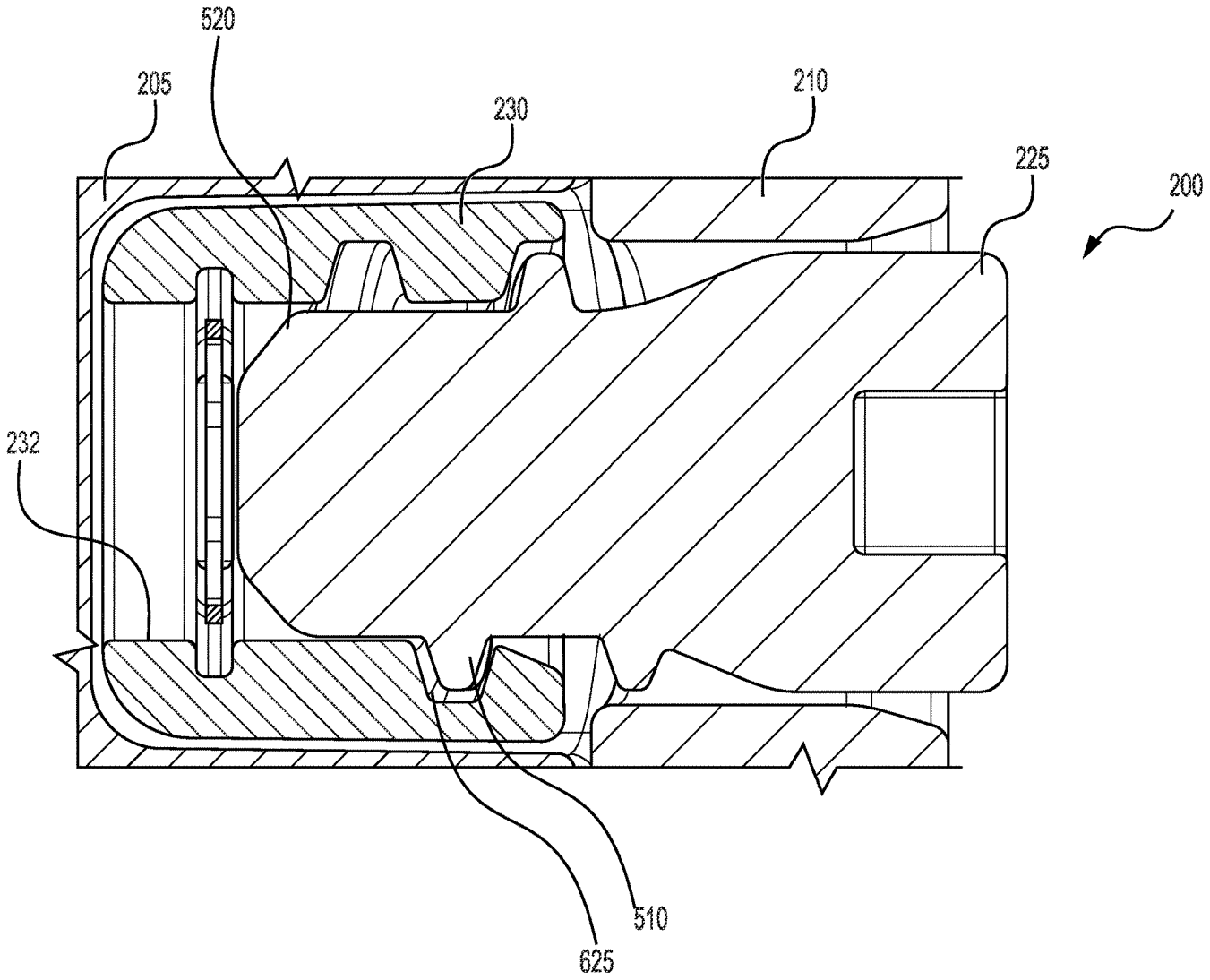
Figure 43:
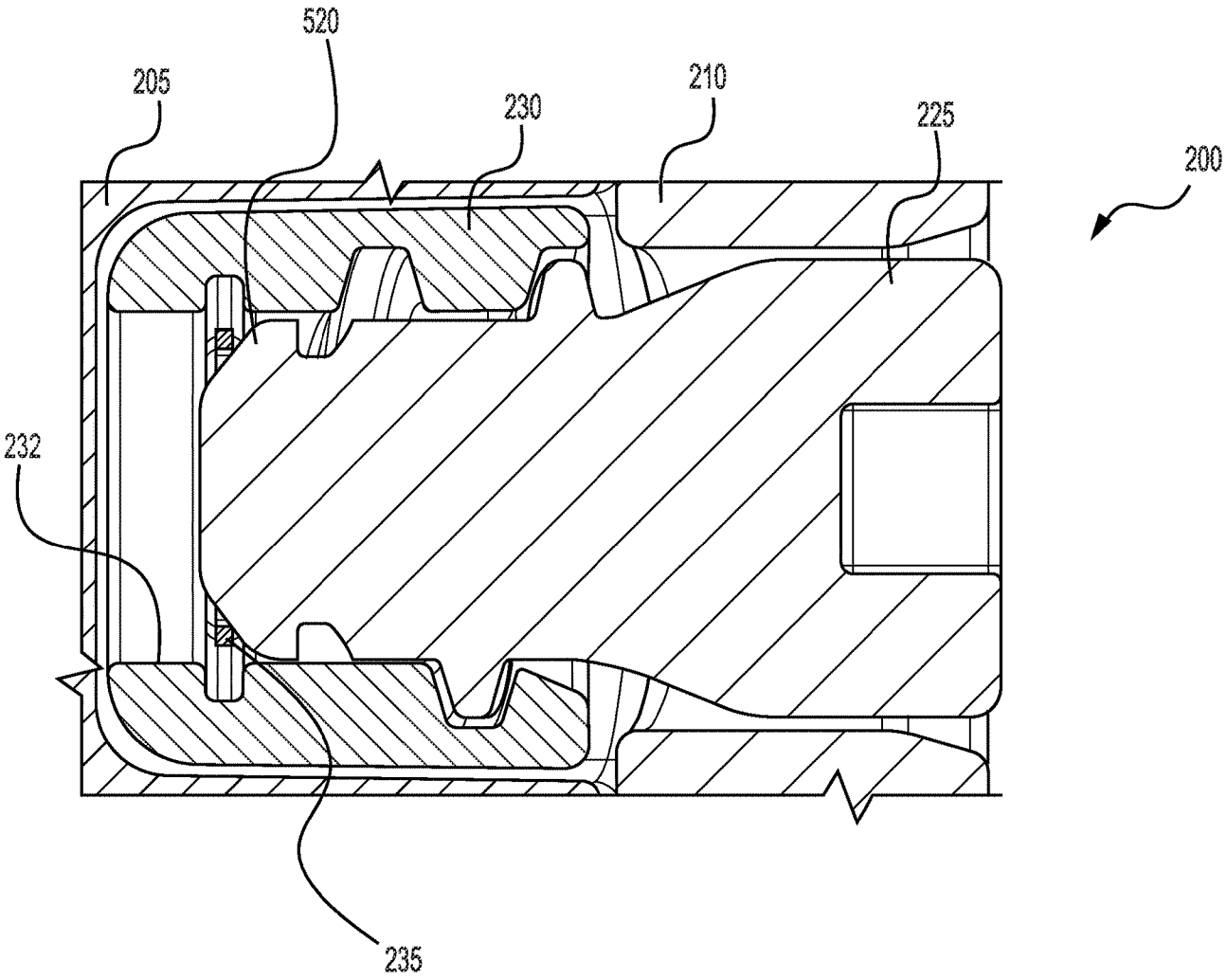
Figure 44:
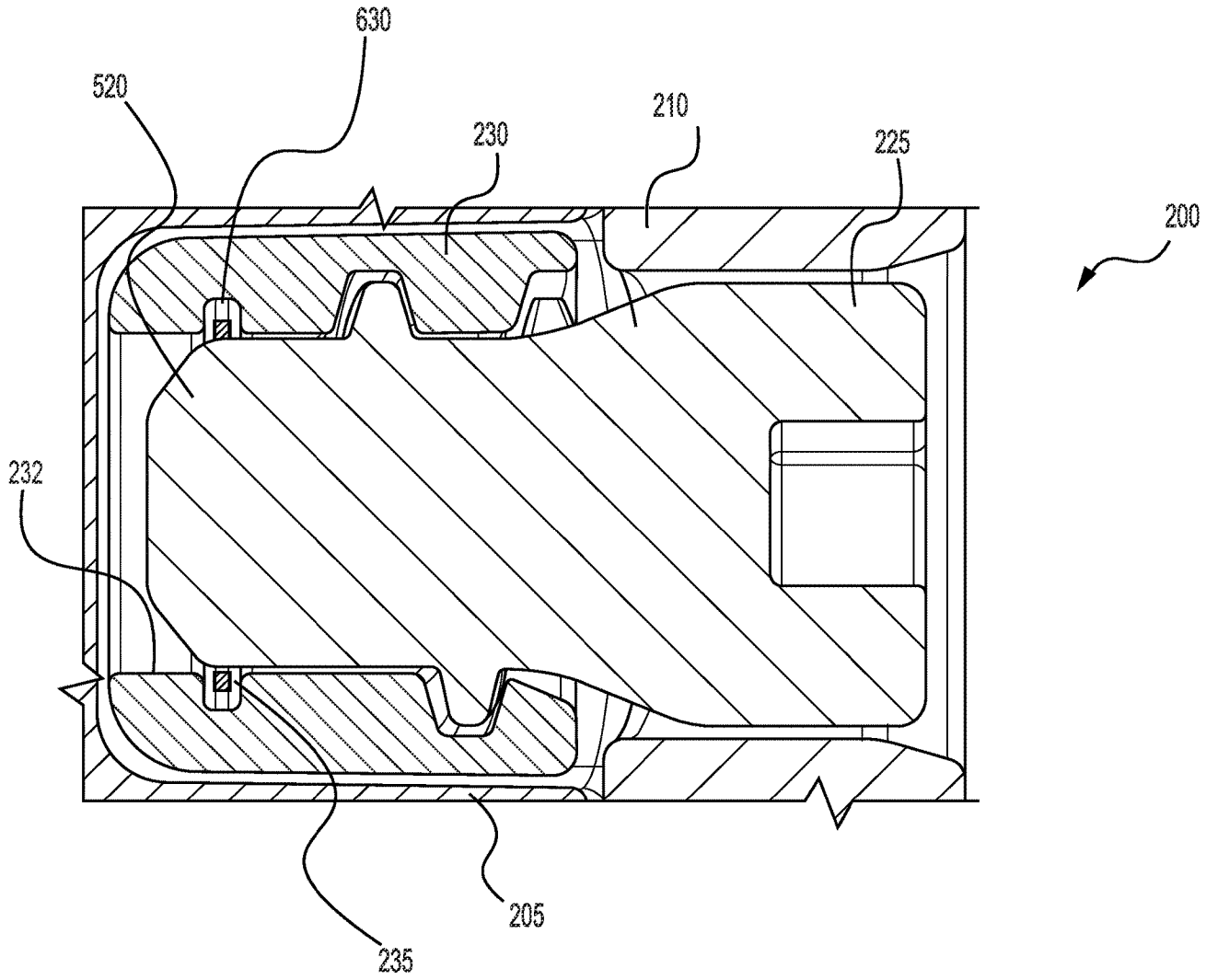
Figure 45:
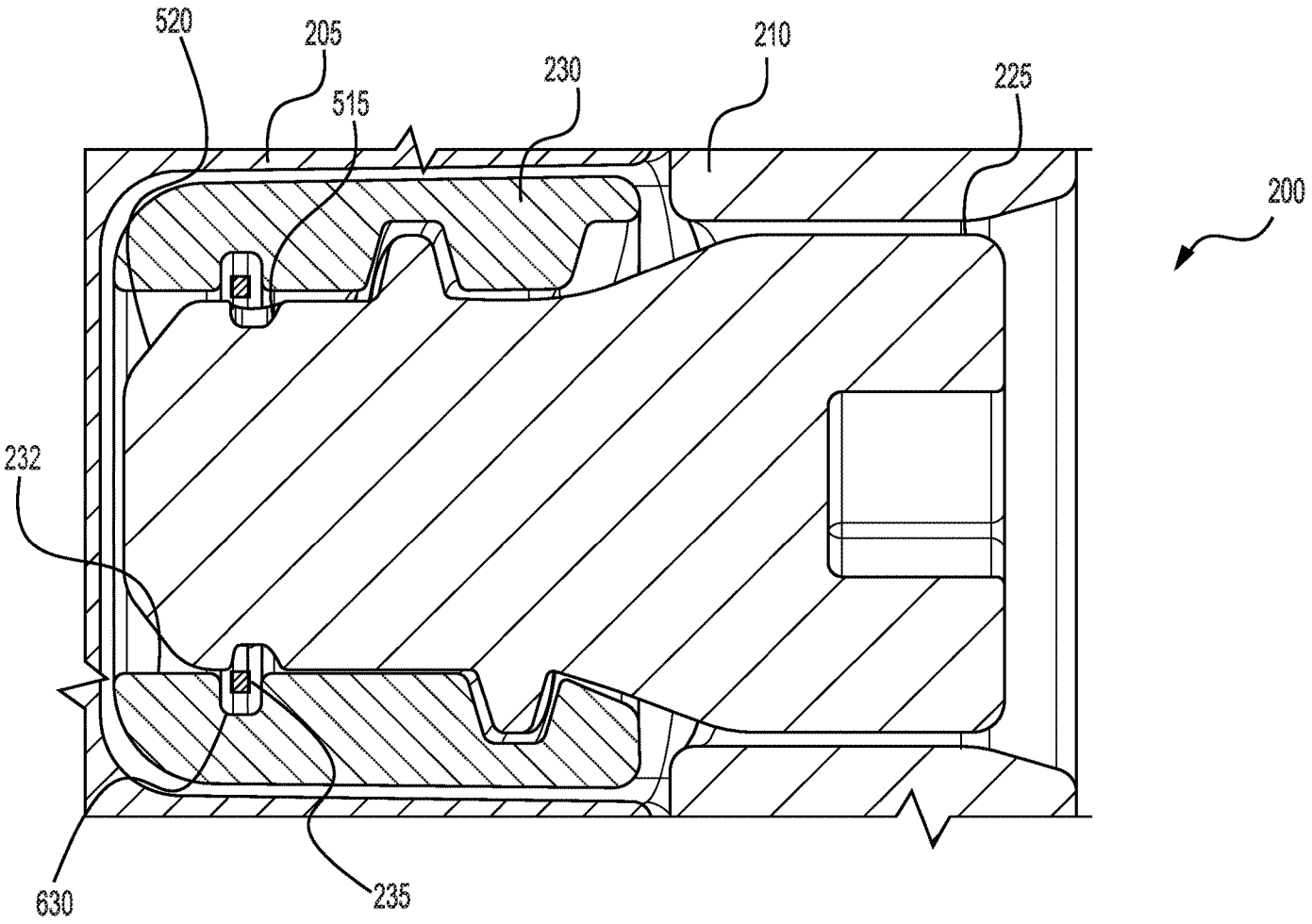
Figure 46:
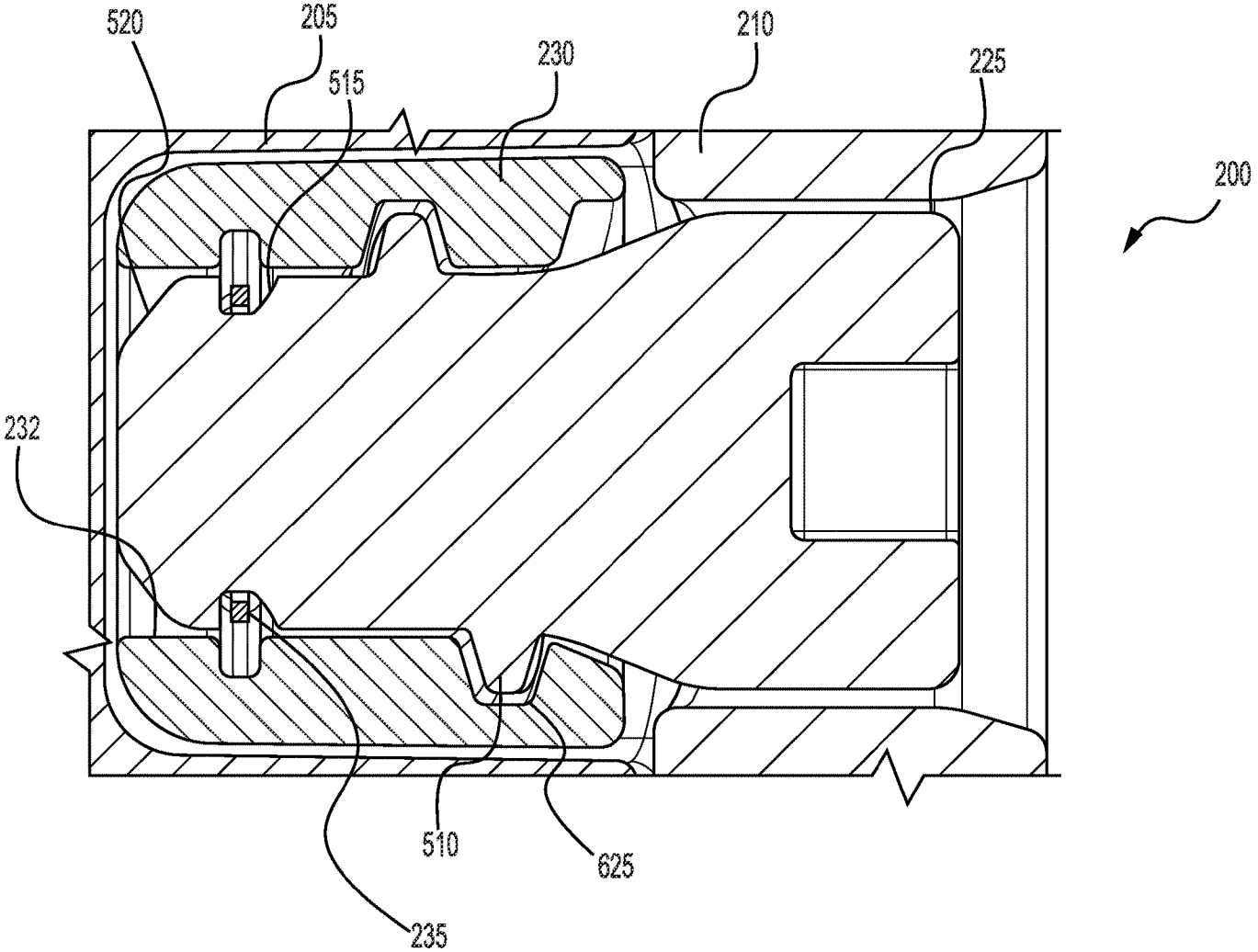

FIGS. 41-46 depict exemplary section views of retention mechanism 200, taken along the line E-E as depicted in FIG. 36, as retainer 225 is being installed in retainer block 230. FIG. 41 depicts retainer 225 at a 450° position, where a 0° position represents a locked position in which retainer 225 is fully installed in retainer block 230. As depicted in FIG. 41, retainer 225 may be partially installed within retainer block 230 as thread 510 of retainer 225 begins interacting with internal thread 625 of retainer block 230. Spring 235 may be in a natural resting position within retainer block 230. FIG. 42 depicts retainer 225 in a 270° position. In this 270° position, retainer 225 may be further rotated into retainer block 230, providing increased contact between thread 510 of retainer 225 and internal thread 625 of retainer block 230. FIG. 43 depicts retainer 225 in a 180° position. In this 180° position, retainer 225 may be further rotated into retainer block 230. Chamfered bottom surface 520 may begin contacting spring 235. Chamfered bottom surface 520 may aid in deflecting spring 235 as retainer 225 is rotated into retainer block 230. FIG. 44 depicts retainer 225 in a 70° position. In this 70° position, spring 235 may be deflected into cutout 630 of retainer block 230. Retainer 225 may be deflecting spring 235 into cutout 630 of retainer block 230 as it is further rotated into retainer block 230. FIG. 45 depicts retainer in a 25° position. In this 25° position, spring 235 may be deflected by retainer 225 into cutout 630 of retainer block 230. Spring 235 may begin interacting with detent cutouts 515 of retainer 225 as retainer 225 is rotated further into retainer block 230. FIG. 46 depicts retainer 225 in a 0° locked position. In this position, retainer 225 may be installed within retainer block 230 and spring 235 may be engaged within detent cutouts 515. Internal thread 625 of retainer block 230 may be fully interconnected with thread 510 of retainer 225 to prevent linear movement of retainer 225 within retainer block 230. As depicted in FIG. 46, spring 235 may no longer be deflected and may be locked within detent cutouts 515. When in the locked position as depicted in FIG. 46, detent cutouts 515 may interact with spring 235 to prevent rotation of retainer 225 during use of the implement 100 (see FIGS. 1-2). The locked position of FIG. 46 may also provide stability to retainer 225 if retainer 225 begins to move out of alignment from excess loading of the tip assembly 110 (see FIG. 3).

Figure 47:
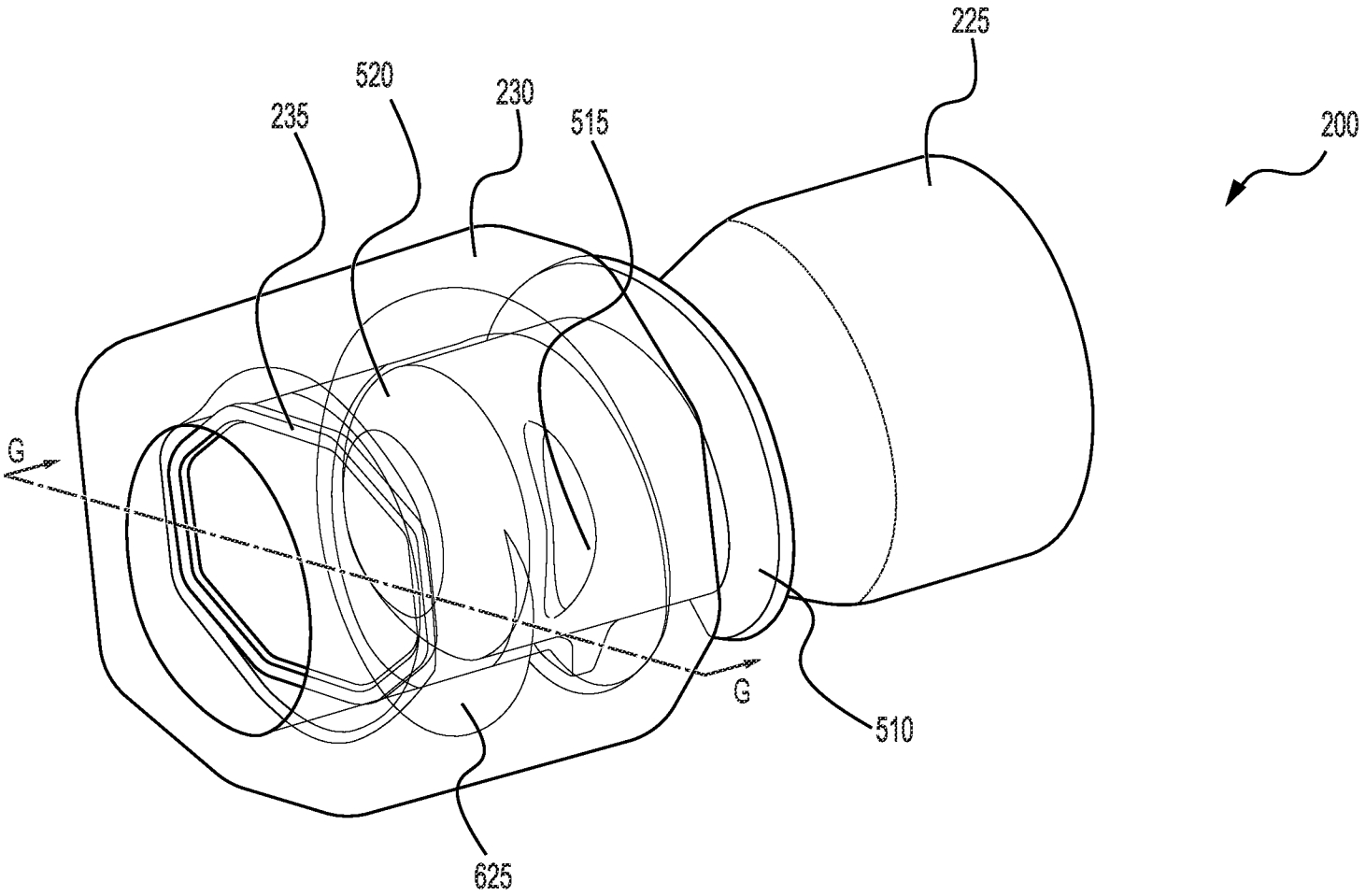
FIGS. 47-52 are three-dimensional renderings of the retention mechanism of FIG. 30 as the retainer of FIG. 15 is being installed within the retainer block of FIG. 19.
Figure 48:
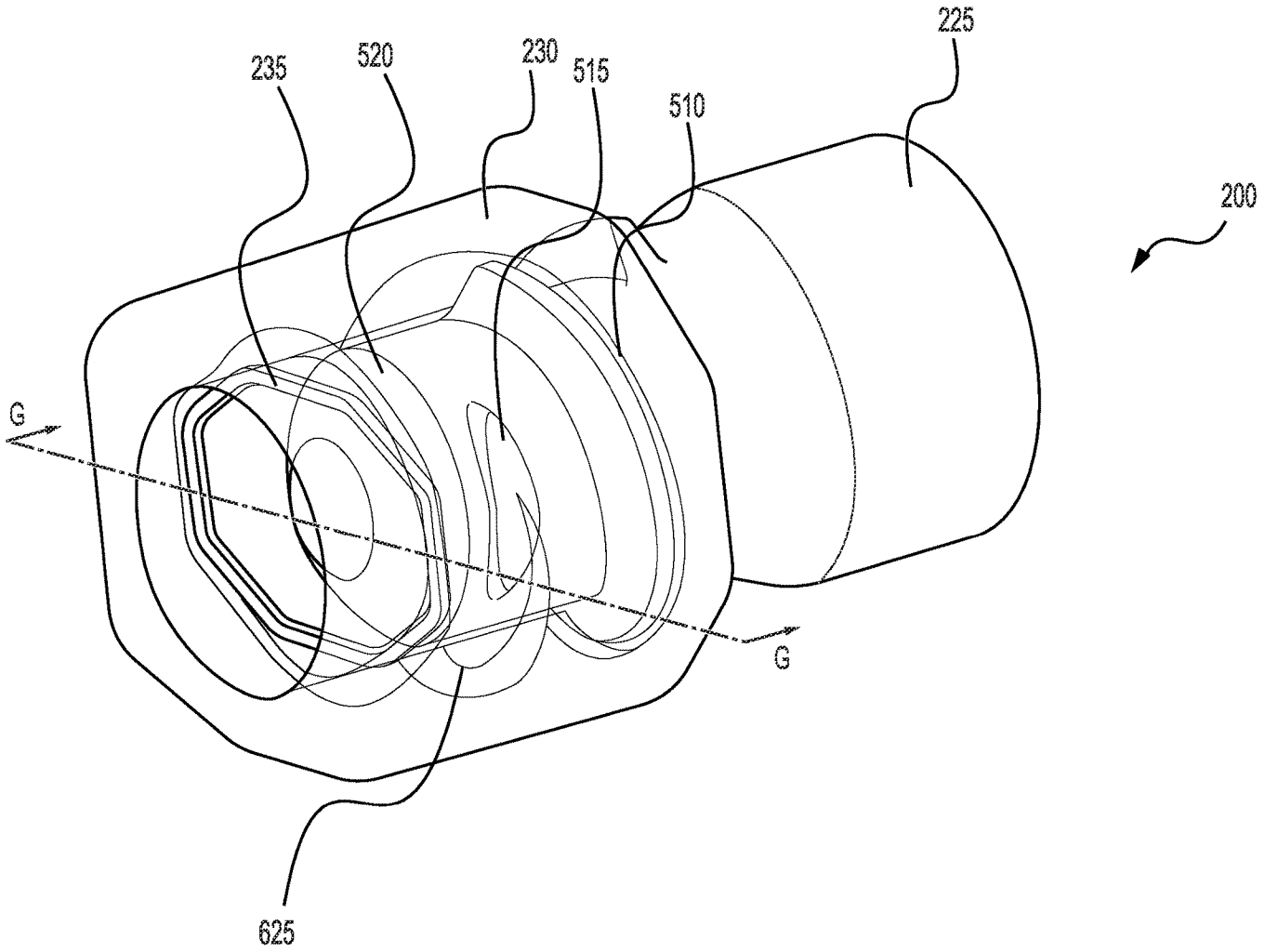
Figure 49:
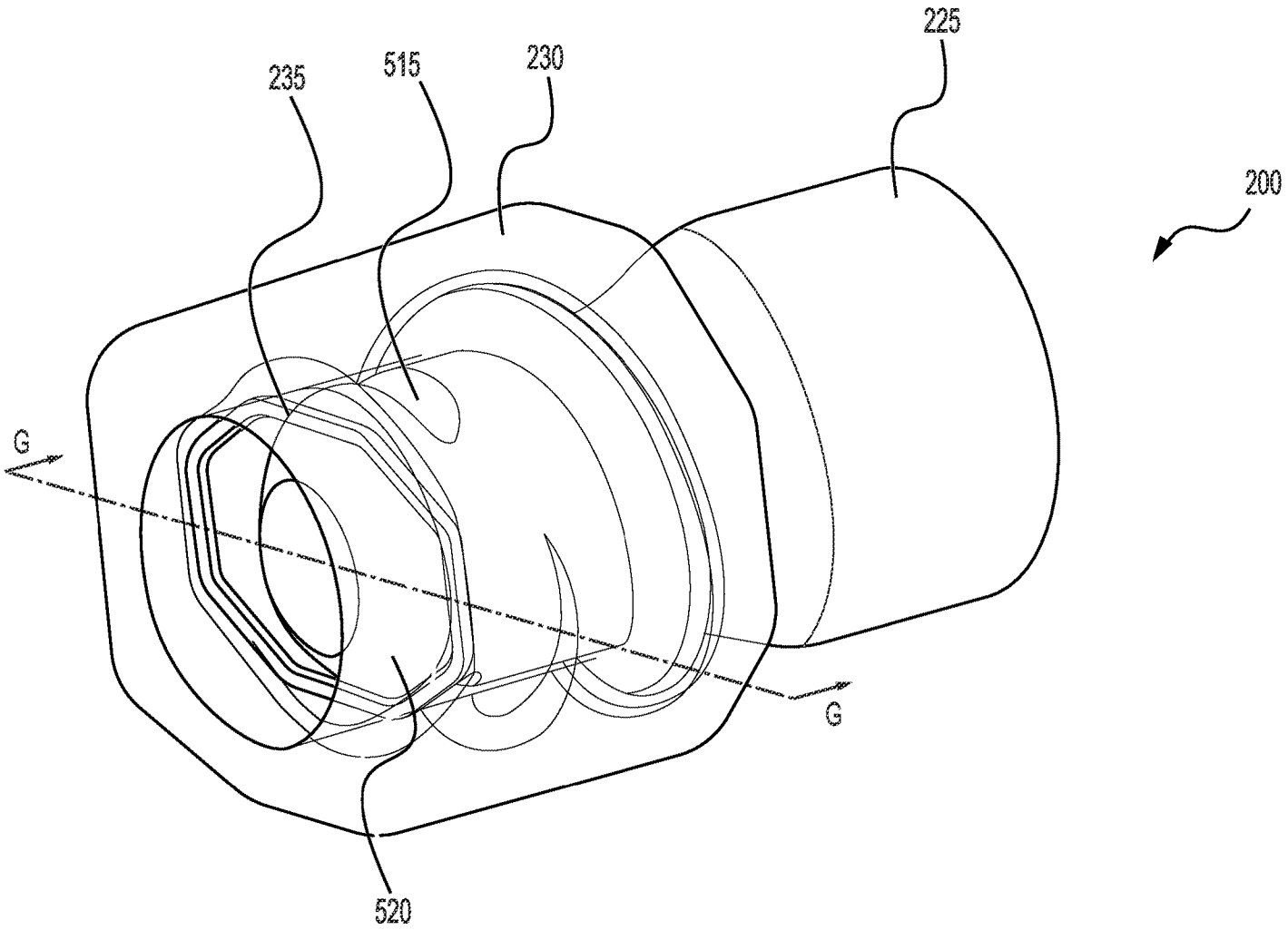
Figure 50:
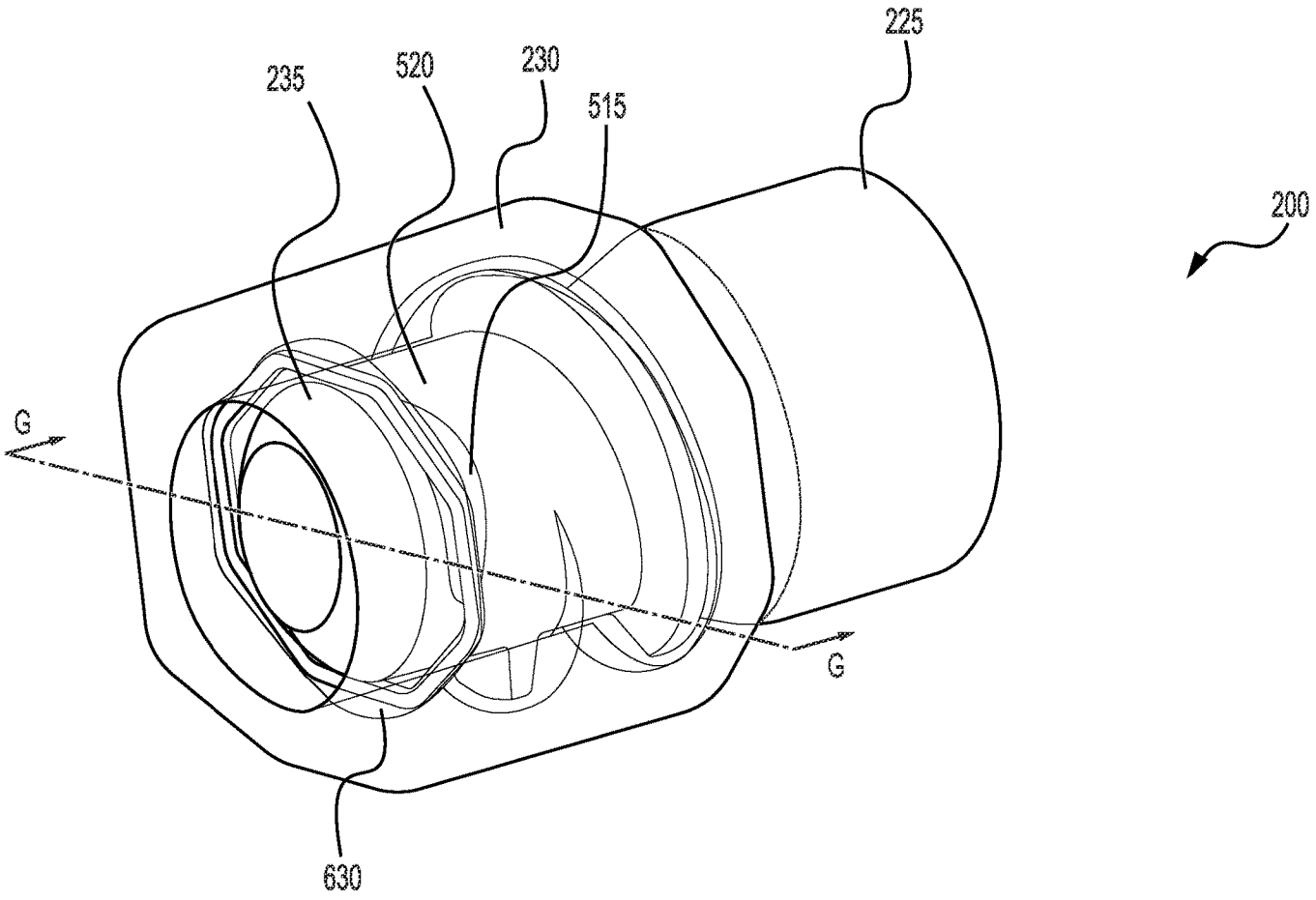
Figure 51:
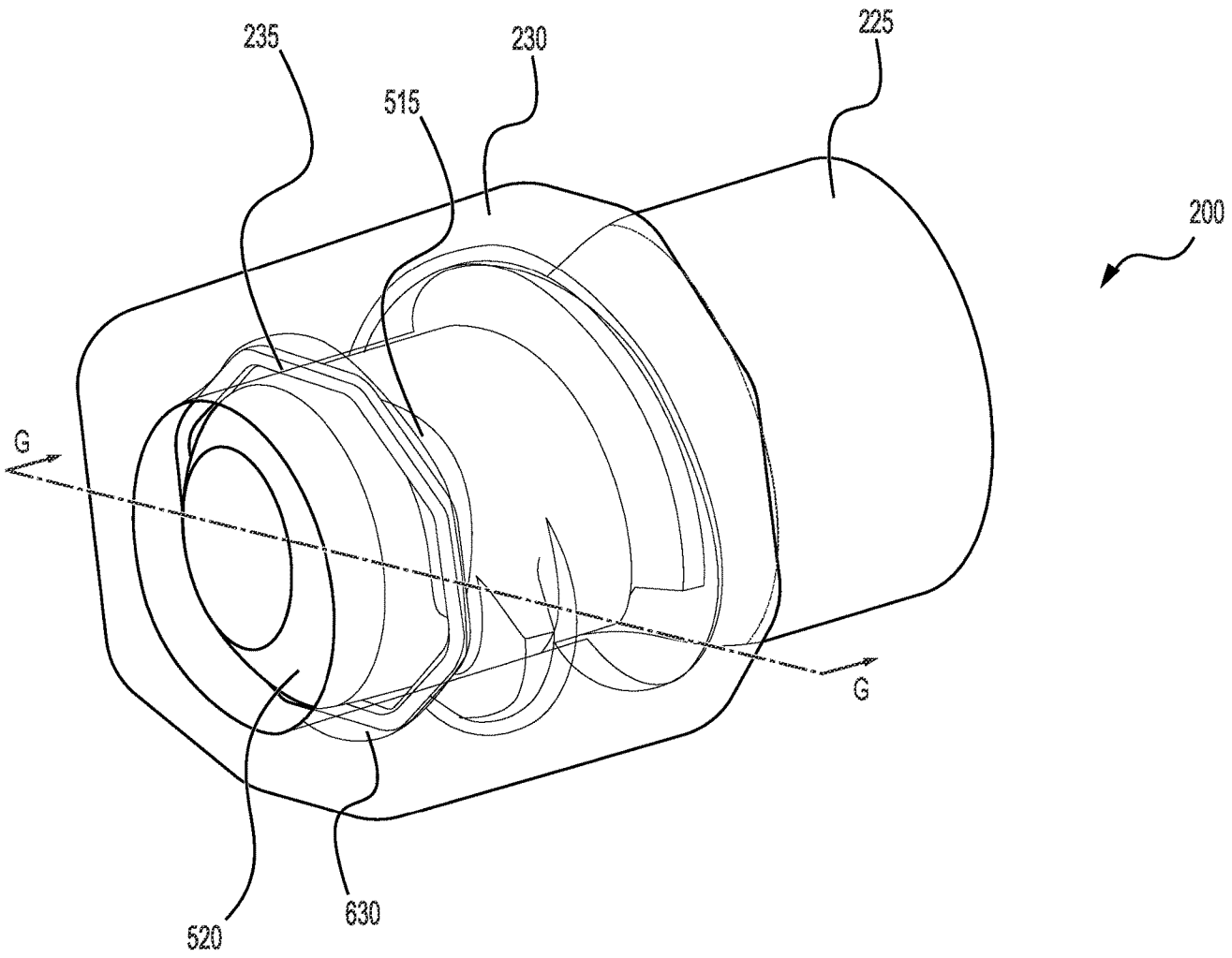
Figure 52:
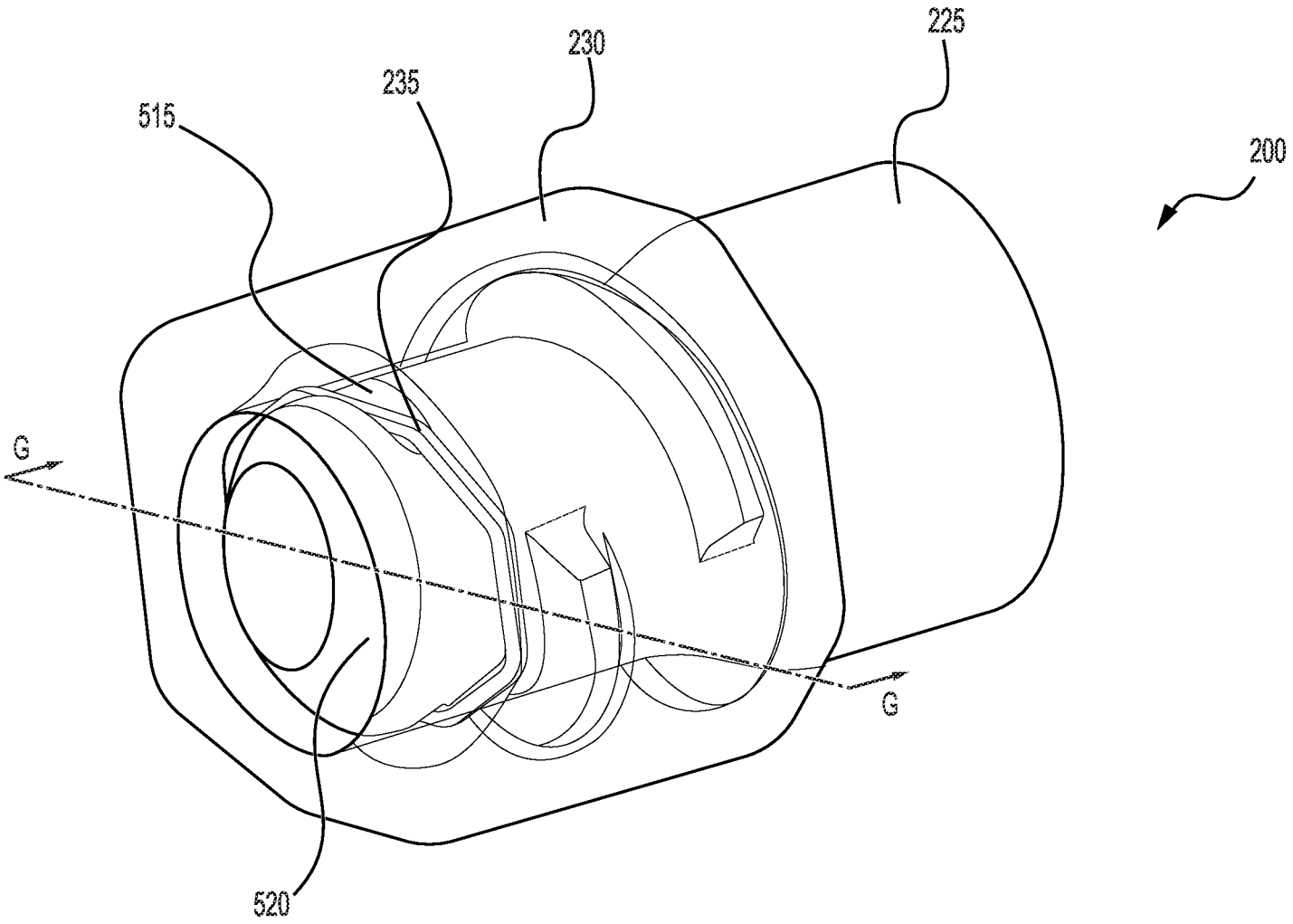

FIGS. 47-52 depict three-dimensional renderings of retention mechanism 200 as retainer 225 is being installed within retainer block 230. FIG. 47 depicts retainer 225 at a 450° position, where a 0° position represents a locked position in which retainer 225 is fully installed in retainer block 230. As depicted in FIG. 47, retainer 225 may be partially installed within retainer block 230 as thread 510 of retainer 225 begins interacting with internal thread 625 of retainer block 230. Spring 235 may be in a natural resting position within retainer block 230. FIG. 48 depicts retainer 225 in a 270° position. In this 270° position, retainer 225 may be further rotated into retainer block 230, providing increased contact between thread 510 of retainer 225 and internal thread 625 of retainer block 230. FIG. 49 depicts retainer 225 in a 180° position. In this 180° position, retainer 225 may be further rotated into retainer block 230. Chamfered bottom surface 520 may begin contacting spring 235. Chamfered bottom surface 520 may allow retainer 225 to deflect spring 235 as retainer 225 is rotated into retainer block 230. FIG. 50 depicts retainer 225 in a 70° position. In this 70° position, spring 235 may be deflected into cutout 630 of retainer block 230. Retainer 225 may deflect spring 235 into cutout 630 of retainer block 230 as it is further rotated into retainer block 230. FIG. 51 depicts retainer in a 25° position. In this 25° position, spring 235 may be deflected by retainer 225 into cutout 630 of retainer block 230. Spring 235 may begin interacting with detent cutouts 515 of retainer 225 as retainer 225 is rotated further into retainer block 230. FIG. 52 depicts retainer 225 in a 0° locked position. In this position, retainer 225 may be installed within retainer block 230 and spring 235 may be engaged within detent cutouts 515. As depicted in FIG. 52, spring 235 may no longer be deflected and may be locked within detent cutouts 515. When in the locked position as depicted in FIG. 52, detent cutouts 515 may interact with spring 235 to prevent rotation of retainer 225 during use of the implement 100 (see FIGS. 1-2). The locked position of FIG. 52 may also provide stability to retainer 225 if retainer 225 begins to move out of alignment from excess loading of the tip assembly 110 (see FIG. 3).

Figure 53:
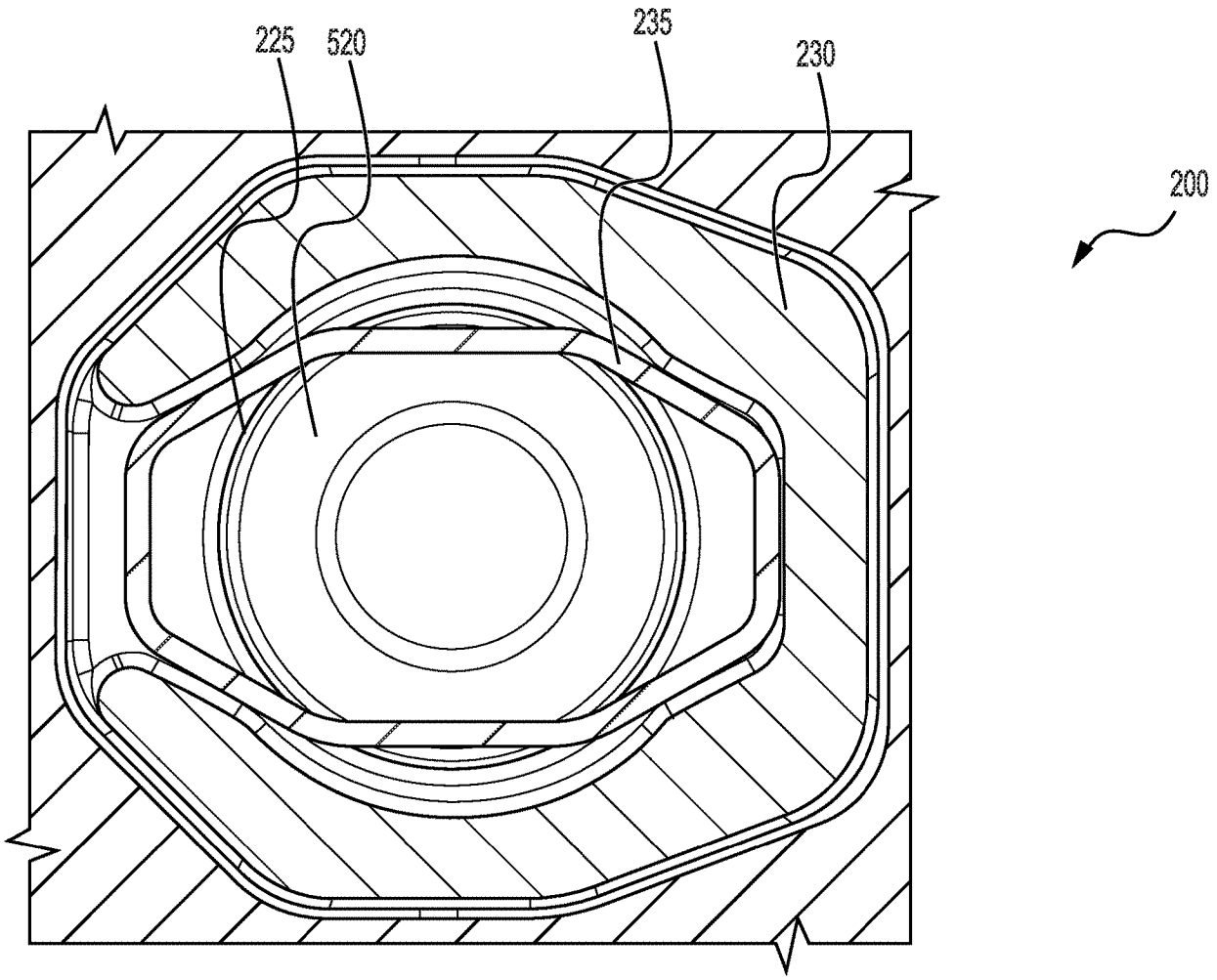
FIGS. 53-58 are cross-sectional views, along line G-G of FIGS. 47-52, of the retention mechanism of FIG. 30 as the retainer of FIG. 15 is being installed within the retainer block of FIG. 19.
Figure 54:
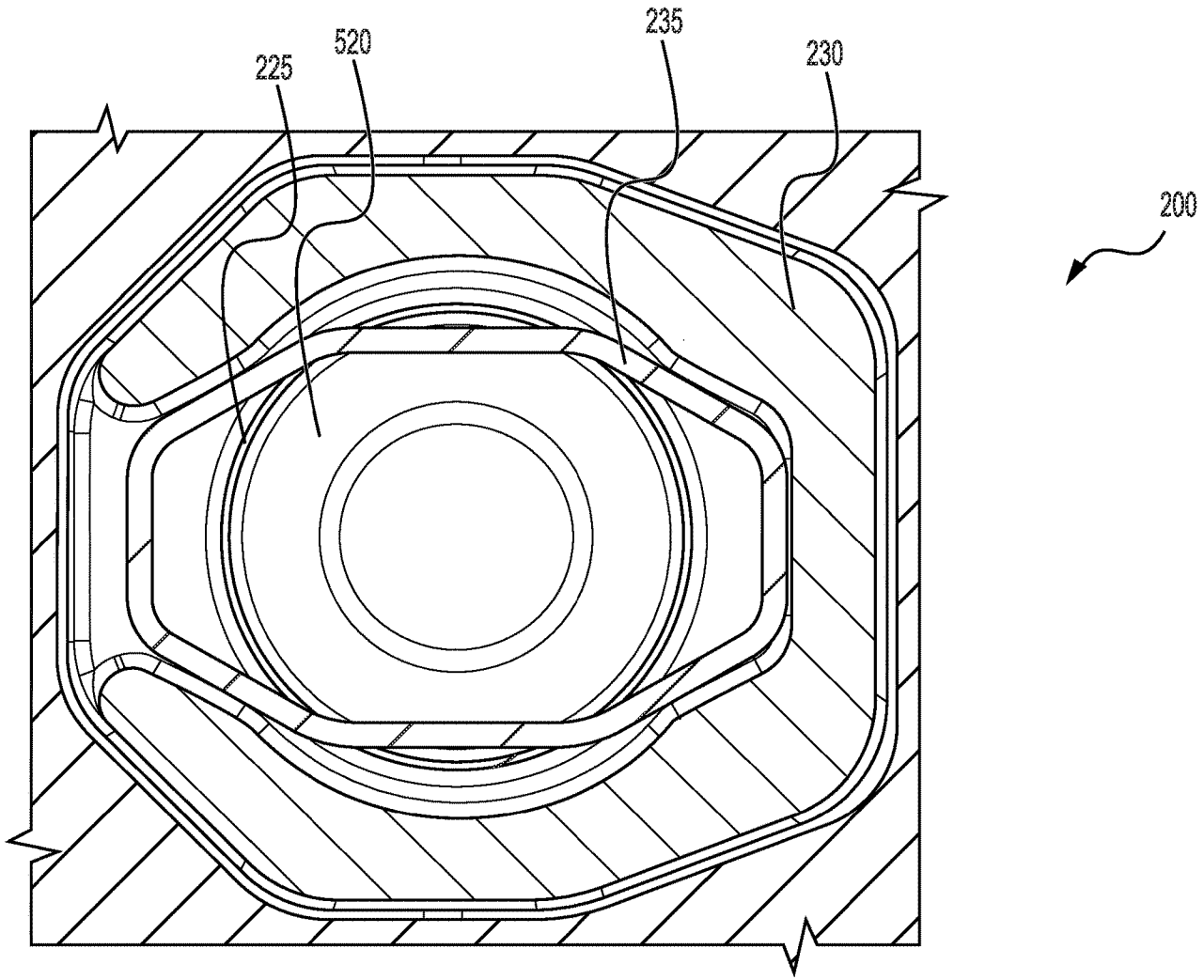
Figure 55:
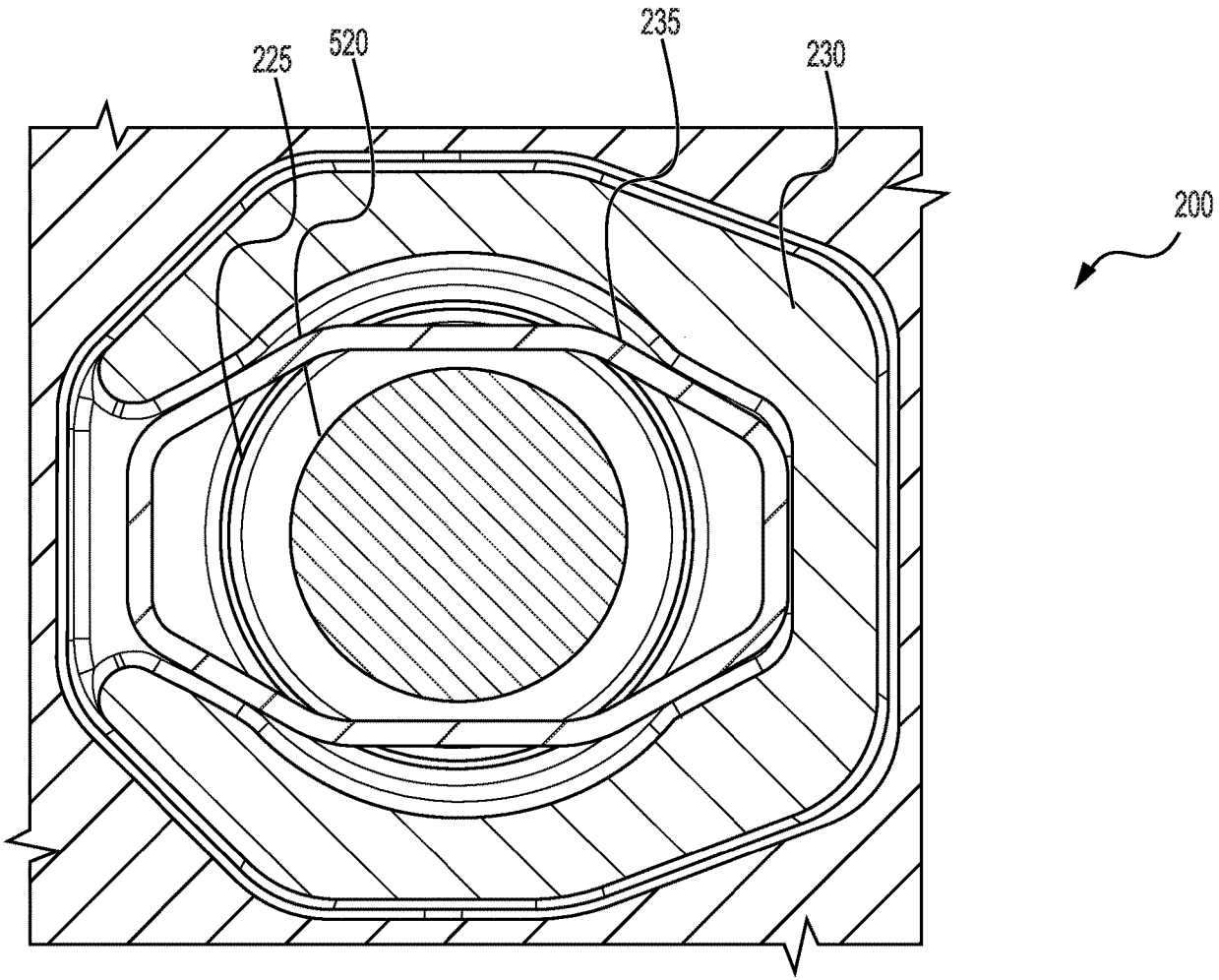
Figure 56:
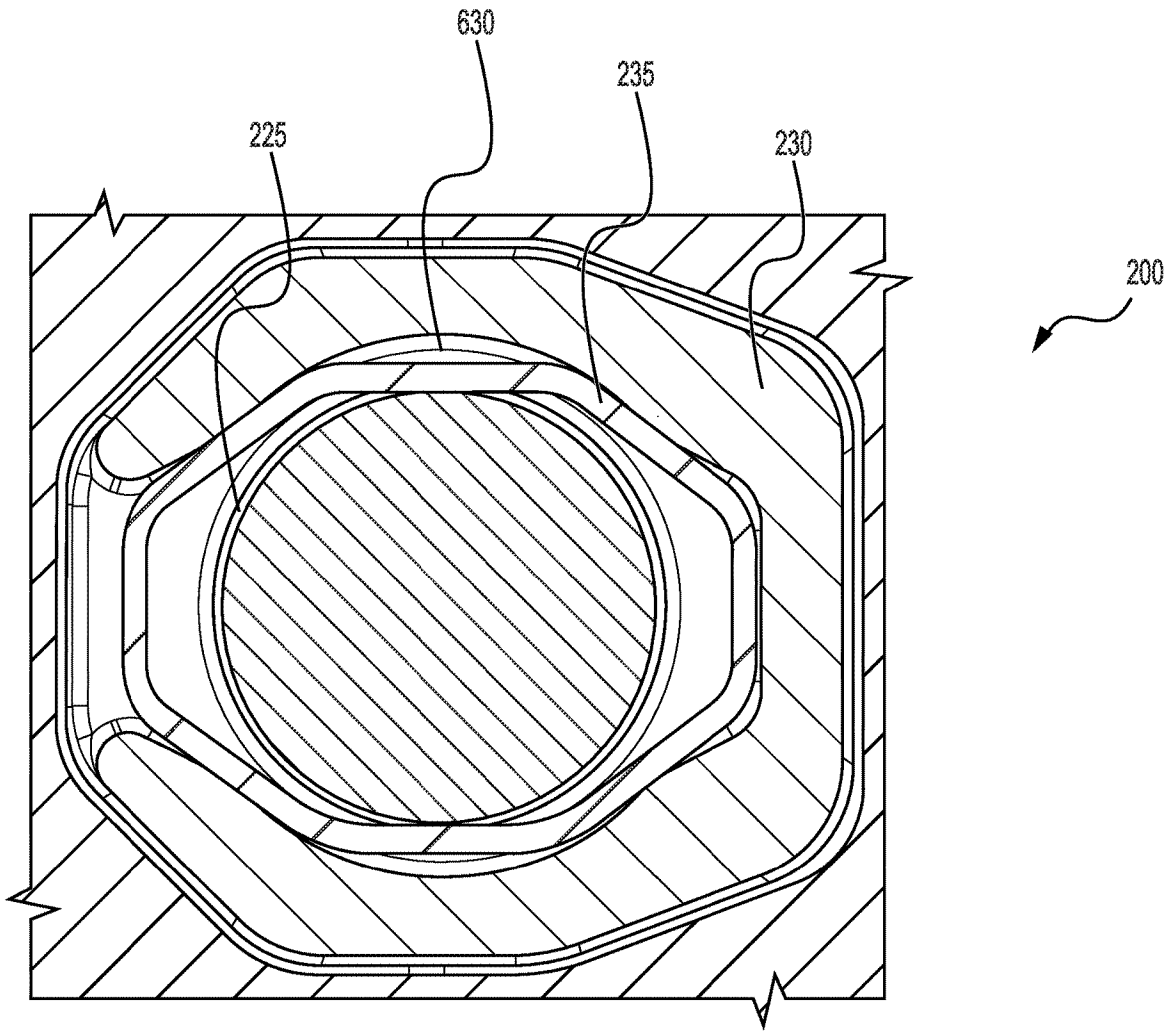
Figure 57:
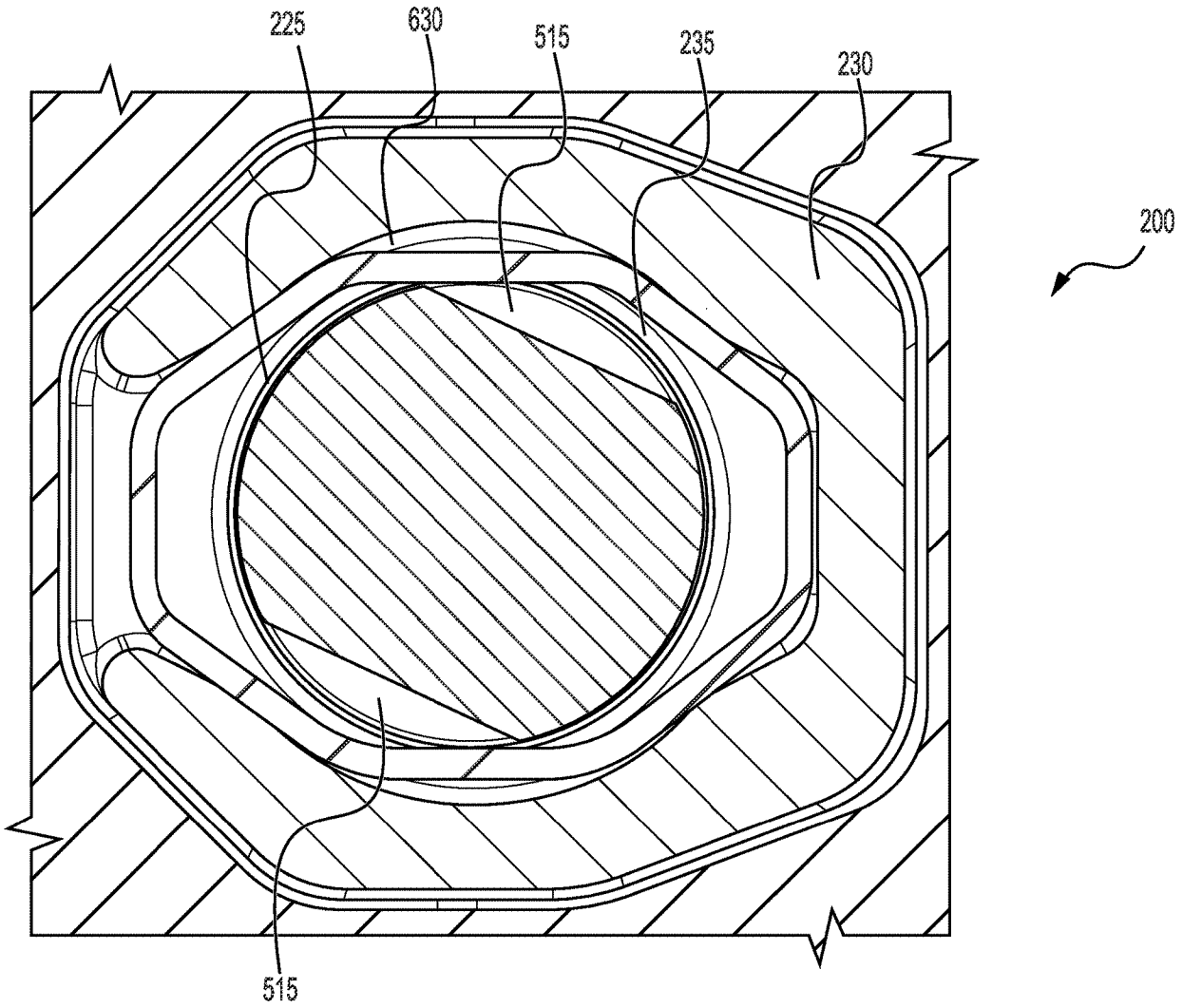
Figure 58:
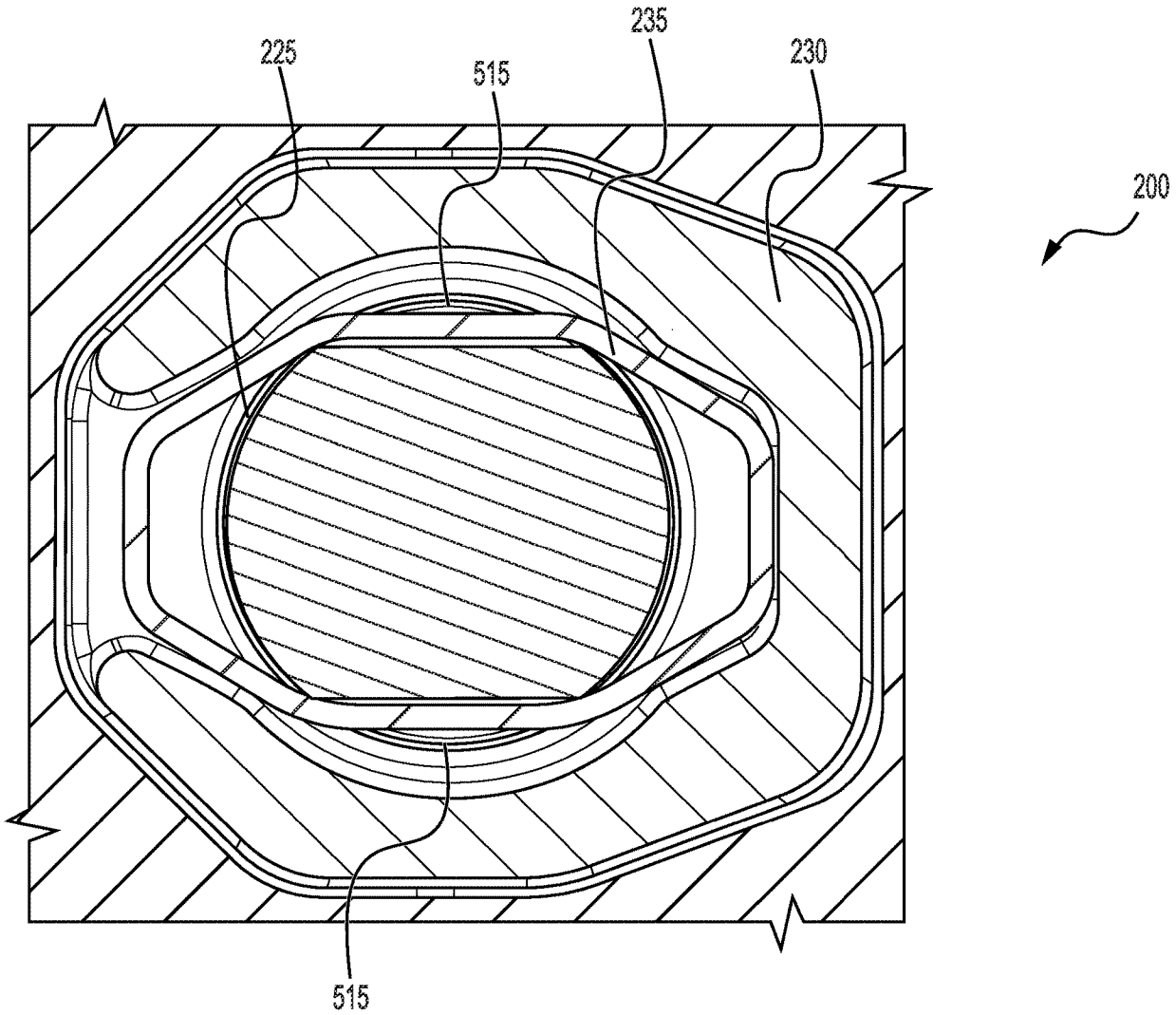

FIGS. 53-58 depict cross-sectional views of retention mechanism 200, taken along the line G-G as depicted in FIGS. 47-52, respectively, as retainer 225 is installed within retainer block 230. FIG. 53 depicts retainer 225 at a 450° position, where a 0° position represents a locked position in which retainer 225 is fully installed in retainer block 230. As depicted in FIG. 53, spring 235 may be in a natural resting position within retainer block 230. FIG. 54 depicts retainer 225 in a 270° position. In this 270° position, retainer 225 may be further rotated into retainer block 230, and spring 235 may be in a natural resting position within retainer block 230. FIG. 55 depicts retainer 225 in a 180° position. In this 180° position, chamfered bottom surface 520 of retainer 225 may begin contacting spring 235. Chamfered bottom surface 520 may allow retainer 225 to deflect spring 235 as retainer 225 is rotated into retainer block 230. FIG. 56 depicts retainer 225 in a 70° position. In this 70° position, spring 235 may be deflected into cutout 630 of retainer block 230. Retainer 225 may deflect spring 235 into cutout 630 of retainer block 230 as it is further rotated into retainer block 230. FIG. 57 depicts retainer in a 25° position. In this 25° position, spring 235 may be deflected by retainer 225 into cutout 630 of retainer block 230. Spring 235 may begin interacting with detent cutouts 515 of retainer 225 as retainer 225 is rotated further into retainer block 230. FIG. 58 depicts retainer 225 in a 0° locked position. In this position, retainer 225 may be installed within retainer block 230 and spring 235 may be engaged within detent cutouts 515. As depicted in FIG. 58, spring 235 may no longer be deflected and may be locked within detent cutouts 515. When in the locked position as depicted in FIG. 58, detent cutouts 515 may interact with spring 235 to prevent rotation of retainer 225 during use of the implement 100 (see FIGS. 1-2). The locked position of FIG. 58 may also provide stability to retainer 225 if retainer 225 begins to move out of alignment from excess loading of the tip assembly 110 (see FIG. 3).

It will be apparent that various modifications and variations can be made to the disclosed retention system with threaded block locking mechanism. Other embodiments will be apparent from consideration of the specification and practice of the disclosed method and apparatus. It is intended that the specification and examples be considered as exemplary only, with a true scope being indicated by the following claims and their equivalents.

What is claimed is:

1. A retention mechanism for connecting a ground engaging tip and an adapter, the retention mechanism comprising:
- a spring;
- a retainer block configured for insertion into a cutout in the adapter, wherein the retainer block comprises:
  - a cavity having an internal thread;
  - an outer surface comprising a contact surface, a back surface opposite the contact surface, and a plurality of angled surfaces between the contact surface and the back surface; and
  - a slot that extends through the back surface and is configured to receive the spring; and
- a retainer configured for insertion in the cavity of the retainer block, wherein the retainer comprises:
  - a threaded outer surface configured to engage with the internal thread of the retainer block;
  - a detent cutout configured to receive a portion of the spring; and
  - a chamfered bottom surface configured to engage with and deflect the portion of the spring.

2. The retention mechanism of claim 1, wherein the spring further comprises:
- a rear portion;
- a front portion that is narrower than the rear portion;
- a first side portion; and
- a second side portion.

3. The retention mechanism of claim 2, wherein the front portion of the spring comprises one of a flat front portion, a rounded front portion, a concave front portion, or a convex front portion.

4. The retention mechanism of claim 1, wherein a cross section of the spring comprises at least one of a square cross section, a round cross section, a rectangular cross section, or an elliptical cross section.

5. The retention mechanism of claim 1, wherein the retainer block further comprises a cutout within a body of the retainer block for deflection of the spring.

6. The retention mechanism of claim 1, wherein a thread wrap angle of the retainer comprises an angle ranging between 90 degrees and 540 degrees.

7. The retention mechanism of claim 1, wherein the detent cutout comprises a lower surface and an angled upper surface.

8. The retention mechanism of claim 1, wherein the retainer further comprises a pocket for removing the retainer from the retainer block.

9. The retention mechanism of claim 8, wherein the pocket has a square shape.

10. An adapter nose for connecting a ground engaging tip to a base edge of a ground engaging implement, the adapter nose comprising:
- a front surface including a bottom edge, opposing side edges extending from and disposed generally perpendicular to the bottom edge, and a top edge disposed generally parallel to the bottom edge;
- a top surface;
- a bottom surface, wherein the top surface and the bottom surface extend forward from a rear edge of the adapter nose and converge at the front surface of the adapter nose;
- first and second side surfaces extending forward from the rear edge of the adapter nose to the front surface; and
- a cutout in the first side surface configured to accept a retainer block, wherein the cutout comprises a plurality of inner side surfaces connected to a base surface by a plurality of inner rounded surfaces.

11. The adapter nose of claim 10, wherein the plurality of inner side surfaces comprise a front surface, a front upper surface, an upper surface, a rear upper surface, a rear surface, a rear lower surface, a lower surface, and a front lower surface.

12. The adapter nose of claim 11, wherein the plurality of inner side surfaces further comprise a plurality of transition side surfaces.

13. The adapter nose of claim 11, wherein the front surface of the cutout is planar and parallel to the front surface of the adapter nose.

14. The adapter nose of claim 11, wherein the rear surface of the cutout is planar and parallel to the rear edge of the adapter nose.

15. The adapter nose of claim 10, wherein the base surface is recessed in the adapter nose at a cutout depth, wherein the cutout depth comprises a depth greater than ten percent of a rear nose width.

16. A tip assembly comprising:
- an adapter comprising an adapter nose, wherein the adapter nose comprises:
  - a front surface;
  - a top surface;
  - a bottom surface, wherein the top surface and the bottom surface extend forward from a rear edge of the adapter nose and converge at the front surface of the adapter nose;
  - first and second side surfaces extending forward from the rear edge of the adapter nose to the front surface; and
  - a cutout in the first side surface, wherein the cutout comprises a plurality of inner side surfaces connected to an inner surface by a plurality of inner rounded surfaces;
- a ground engaging tip, comprising a nose cavity configured to receive the adapter nose, wherein the ground engaging tip comprises:
  - a rear edge;
  - a top outer surface;
  - a bottom outer surface, wherein the top outer surface and the bottom outer surface extend forward from the rear edge and converge at a front edge of the ground engaging tip;
  - first and second lateral outer surfaces extending forward from the rear edge to the front edge, wherein the first lateral outer surface includes an opening;
- a retention mechanism comprising:
  - a spring;
  - a retainer block configured for insertion into the cutout in the first side surface of the adapter, the retainer block including:
    - a cavity; and a slot extending transverse to the cavity and through an outer surface of the retainer block, the slot configured to receive the spring; and a retainer configured for insertion in the cavity of the retainer block through the opening in the first lateral outer surface of the ground engaging tip, the retainer being further configured to receive at least a portion of the spring in a detent cutout of the retainer.

17. The tip assembly of claim 16, wherein a diameter of the opening is sixty percent of a height of the nose cavity.

18. The tip assembly of claim 16, wherein the opening further comprises a pre-seated surface.

19. The tip assembly of claim 16, wherein the opening further comprises a drafted surface area around a circumference of the opening.

20. The tip assembly of claim 16, wherein the ground engaging tip further comprises a second opening on the second lateral outer surface.

* * * * *